US007106256B2

(12) United States Patent
Watanabe et al.

(10) Patent No.: US 7,106,256 B2
(45) Date of Patent: Sep. 12, 2006

(54) ANTENNA DEVICE

(75) Inventors: Fuminori Watanabe, Yokohama (JP); Ryuta Sonoda, Yokohama (JP); Koji Ikawa, Yokohama (JP); Kazuhiko Niwano, Yokohama (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 10/975,495

(22) Filed: Oct. 29, 2004

(65) Prior Publication Data

US 2006/0038723 A1 Feb. 23, 2006

(30) Foreign Application Priority Data

Nov. 13, 2003 (JP) ..... 2003-384324
May 26, 2004 (JP) ..... 2004-156357

(51) Int. Cl.
*H01Q 1/38* (2006.01)

(52) U.S. Cl. ..... 343/700 MS; 343/846

(58) Field of Classification Search ..... 343/700 MS, 343/846

See application file for complete search history.

(56) References Cited

U.S. PATENT DOCUMENTS

| | | | | |
|---|---|---|---|---|
| 6,512,488 | B1 | 1/2003 | Schantz | 343/795 |
| 6,809,687 | B1 * | 10/2004 | Yuanzhu | 343/700 MS |
| 6,897,808 | B1 * | 5/2005 | Murch et al. | 343/700 MS |
| 6,897,811 | B1 * | 5/2005 | Asai et al. | 343/700 MS |
| 2004/0100406 | A1 | 5/2004 | Hironori | 343/700 MS |
| 2004/0100407 | A1 | 5/2004 | Hironori | 343/700 MS |
| 2004/0100408 | A1 | 5/2004 | Hironori | 343/700 MS |
| 2004/0100409 | A1 * | 5/2004 | Okado | 343/700 MS |
| 2005/0156788 | A1 * | 7/2005 | Lin | 343/700 MS |

FOREIGN PATENT DOCUMENTS

| | | |
|---|---|---|
| JP | 10-150318 | 6/1998 |
| JP | 10-276033 | 10/1998 |
| JP | 3273463 | 2/2002 |
| JP | 2002-164731 | 6/2002 |

OTHER PUBLICATIONS

M. Hammoud, et al., "Matching The Input Impedance of A Broadband Disc Monopole", Electronics Letters, vol. 29, No. 4, Feb. 18, 1993, pp. 406-407.

Sung-Bae Cho, et al., "Ultra Wideband Planar Stepped-Fat Dipole Antenna for High Resolution Impulse Radar", 2003 Asia-Pacific Microwave Conference, 4 pages.

Do-Hoon Kwon, et al., "A Small Ceramic Chip Antenna for Ultra-Wideband Systems" 5 pages.

* cited by examiner

*Primary Examiner*—Tan Ho
(74) *Attorney, Agent, or Firm*—Oblon, Spivak, McClelland, Maier & Neustadt, P.C.

(57) ABSTRACT

An antenna body is configured to comprise a dielectric member including a planar radiating conductor and a feeder. The radiating conductor is configured by combining a first forming element and a second forming element so as to share one portion, the first forming element having a circular shape, and the second forming element having a semi-oval shape. The feeder is connected to the radiating conductor at a peripheral portion in the second forming element, which is located on a side of the second forming element seen from the first forming element.

18 Claims, 18 Drawing Sheets

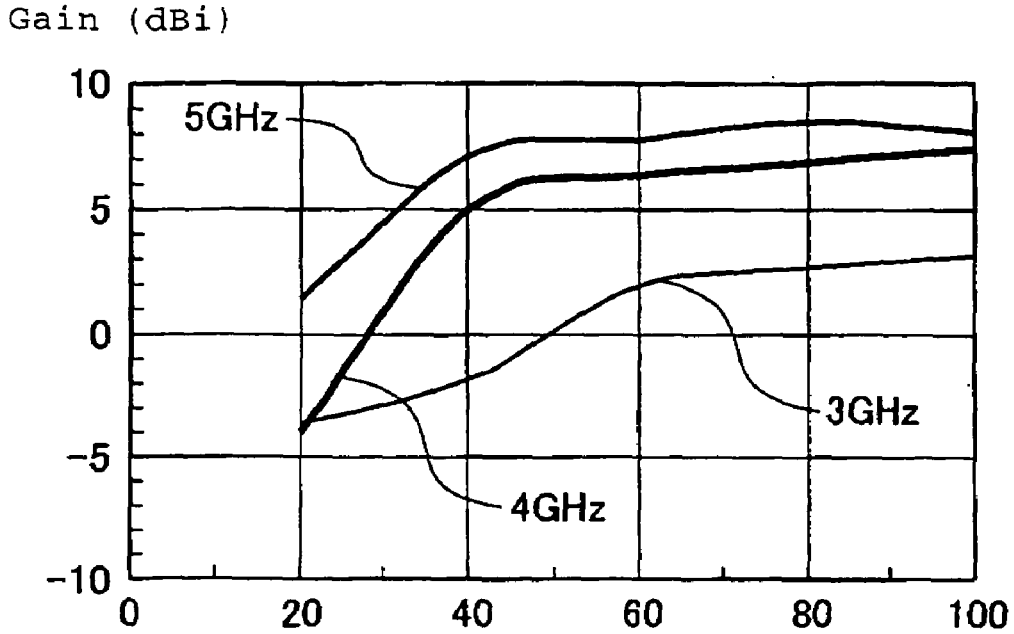
FIG. 27 Length $L_{41}$ in transverse direction (=length $L_{42}$ in vertical direction)
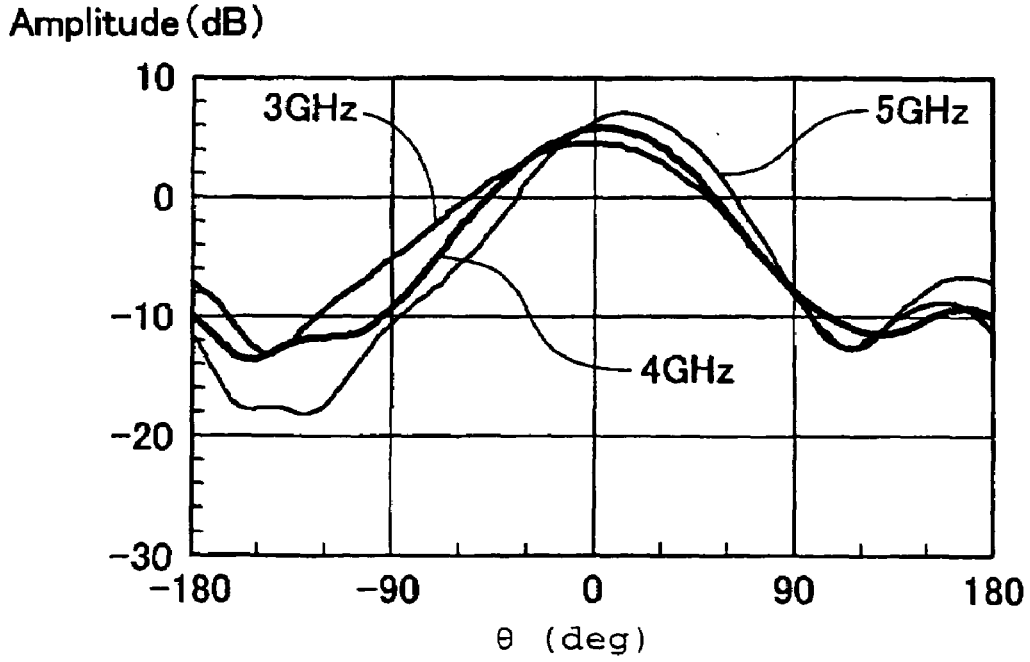
FIG. 28

ANTENNA DEVICE

TECHNICAL FIELD

The present invention relates to an antenna device, in particular an antenna device in a microwave range (3 GHz to 30 GHz) and a millimeter wave range (30 to 300 GHz) used for communication, distance measuring equipment or broadcast.

BACKGROUND ART

Heretofore, a disc monopole antenna, which is disclosed in M. Hammoud et al, "Matching The Input Impedance of A Broadband Disc Monopole", Electron. Lett., Vol. 29, No. 4, pp. 406–407, 1993, has been known as an antenna having an operating frequency band in a wide band. FIG. 31 is a schematic view showing this disc monopole antenna. This disc monopole antenna is configured to include a planar monopole 101 connected to a coaxial line 102. Specifically, the planar monopole 101 is disposed as to be upright with respect to a metal plate 103 at a position away from the metal plate 103 by a distance L. It is possible to provide optimum matching so as to have a desired characteristic by adjusting the distance L.

Additionally, an antenna, which is shown in FIG. 32 and is disclosed in Japanese Patent No. 3,114,798, has been known. This antenna includes a planar monopole 105, which is upright from a metal plate 103. The planar monopole 105 is a monopole, which has such a planar structure to have the transverse width of a disc shape (circular shape) reduced so as to have a tapered shape. This antenna forms a monopole antenna having an operating frequency band adapted for a wide band by using the planar monopole 105, an unshown corner reflector and the metal plate 103. The corner plate has a structure wherein two planar plates having certain dimensions have edges bonded together, and the bonded portion is bent in a dogleg shape. The corner reflector is disposed so as to be perpendicular to the metal plate 103 and have two bonded plates extending orthogonally with each other. The tapered planar monopole 105 has a lower portion formed with a linearly cut-out portion 106 so that the distance between the metal plate 103 and an edge of the tapered planar monopole 105 close thereto is set at a required length L.

Sung-Bae Cho et.al., "ULTRA WIDEBAND PLANAR STEPPED-FAT DIPOLE ANTENNA FOR HIGH RESOLUTION IMPULSE RADAR", 2003 Asia-Pacific Microwave Conference, discloses another planar dipole antenna, which has an operating frequency band in a wide band. This planar antenna has a structure wherein a pair of metal conductors having a similar shape, which serves as a radiating conductor, is disposed on a dielectric member so as to be separated from each other with a certain distance, and power is fed to the paired metal conductors from a region between the separated conductors.

Each of the antenna devices shown in FIG. 31 and FIG. 32 uses a monopole antenna. Each of the antennas is configured to include a radiating element comprising the planar disc monopole 101 or the planar monopole 105 and the metal plate 103. The radiating element and a ground conductor are disposed so as to be perpendicular and orthogonal with each other. Accordingly, the radiating element is disposed to be upright with respect to the ground conductor so as to have a three-dimensional configuration, occupying a three-dimensional space as an antenna having a three-dimensional structure. In the antenna shown in FIG. 31, the metal plate 103 has a large shape having, e.g., 300 mm×300 mm since the metal plate needs to have a size, which is about 10 times the diameter of the planar disc monopole 101. On the other hand, in the antenna device shown in FIG. 32, the antenna and the unshown corner reflector are disposed so as to be perpendicular with respect to the ground conductor. Accordingly, the antenna and the corner reflector are disposed to be upright with respect to the ground conductor so as to have a three-dimensional configuration, occupying a three-dimensional space as a three-dimensionally configured antenna device.

The antennas shown in FIG. 31 and FIG. 32 are not suited for a small size antenna since both antennas are formed in a three-dimensional structure and have a large shape.

Additionally, the antenna device shown in FIG. 32 provides good impedance matching with respect to different frequencies by forming the linearly cut-out portion having a width of about 1 to 2 mm in the tapered planar monopole 105 having a length of 36 mm for instance. However, the operating frequency band is not always in a sufficiently wide band since the radiating conductor comprising the planar monopole 105 has a tapered shape, which is determined in accordance with the dimensions of the reflector stated earlier. For example, the operating frequency band has only a fractional bandwidth of 33%, explanation of a fractional bandwidth being described later.

Although the planar dipole antenna disclosed in the second non-patent document has an operating frequency band in a wide band, this planar antenna is not an antenna having a high degree of freedom in design since the paired metal conductors forming a radiating element need to have a stepped shape.

DISCLOSURE OF THE INVENTION

From these viewpoints, it is an object of the present invention to provide a high gain antenna device, which has a small size of antenna without having an occupied volume as a three-dimensional structure as in prior art, and which has an operating frequency band in a wider range than the prior art and has a high degree freedom in design.

Means for Solving the Problems

In order to attain the problem stated earlier, the present invention provides an antenna device comprising a dielectric member including a planar radiating conductor and a feeder; the radiating conductor comprising a first forming element and a second forming element disposed so as to have a portion common to each other; the first element being formed in a shape selected among a polygon, a substantial polygon, a circle, a substantial circle, an oval and a substantial oval; the second element having at least one portion formed in a shape selected among a polygon, a substantial polygon, a circle, a substantial circle, an oval, a substantial oval, a trapezoid and a substantial trapezoid; and the feeder being connected to the radiating conductor.

The shape of the second forming element may contain not only the entire shape of a polygon, a substantial polygon, a circle, a substantial circle, an oval, a substantial oval, a trapezoid or a substantial trapezoid, but also a portion of a shape selected among these configurations. For example, a semi-circle, a semi-oval, a half configuration of a polygonal or a trapezoid, or another configuration is also applicable.

For example, the feeder is connected to the radiating conductor at a peripheral portion of the second forming element in a peripheral portion of the radiating conductor, which is located on a side of the second forming element as seen from the first forming element. In this case, the feeder is disposed on the same plane as the radiating conductor and is connected to the radiating conductor on this plane.

Or, the feeder may be connected to the radiating conductor from a direction inclined with respect to or from a direction substantially perpendicular to the plane just stated. In this case, the second forming element is not limited to be connected to the radiating conductor at the peripheral portion.

It is preferred that the antenna device have the radiating conductor and the feeder disposed on the dielectric member or in the dielectric member to form an antenna body, that the antenna body be mounted to an insulating substrate; that the insulating substrate has a ground conductor disposed on a surface thereof remote from the dielectric member or disposed therein; and that the antenna body be mounted to the insulating substrate so that the dielectric member is disposed with the radiating conductor being parallel with or substantially parallel with the ground conductor.

In this case, the insulating substrate may include a signal line forming a transmission line along with the ground conductor, the signal line being connected to the feeder. For example, the signal line is connected to the feeder through a via formed in the dielectric member. The dielectric member may have a pair of ground patterns disposed at symmetrical positions with respect to, e.g., the feeder.

The antenna body, which is mounted to the insulating substrate, may be disposed and fixed on a region on an opposite surface of the insulating substrate remote from an exposed portion of the insulating substrate without the ground conductor disposed thereon. In other words, the antenna body is disposed at such a position to avoid confrontation with the ground conductor and to be parallel with the ground conductor.

Additionally, it is preferred that the antenna device further comprise a reflecting member disposed away from the insulating substrate, the reflecting member being configured to reflect a radio wave radiated from the radiating conductor. The reflecting member may comprise, e.g., a metal plate having a flat reflecting surface, or be a reflecting member, which has a configuration containing, e.g., a cylindrical shape, a portion of a cylindrical shape, a spherical shape or a portion of a spherical shape so as to have a reflecting surface formed in a curved surface. For example, the reflecting member comprises a flat plate and is disposed in parallel with or substantially parallel with the ground conductor of the insulating substrate.

Additionally, it is preferred that the antenna device further comprise an air layer disposed between the reflecting member and the insulating substrate. Additionally, it is also preferred that the antenna device further comprise a dielectric layer disposed between the reflecting member and the insulating substrate. In this case, the dielectric layer comprises preferably a dielectric material having a relative dielectric constant in a range from 1.5 to 20, and more preferably a dielectric material having a relative dielectric constant in a range from 2 to 10.

When both of the dielectric layer and the air layer are disposed, it is preferred that the dielectric layer be disposed on a surface of the reflecting member so that the insulating substrate, the air layer, the dielectric layer and the reflecting member are disposed in this order.

In the planar radiating conductor according to the antenna device of the present invention, the first forming element, which is formed in a shape selected among a polygon, a substantial polygon, a circle, a substantial circle, an oval and a substantial oval, and the second forming element, which has at least one portion formed in a shape selected among a polygon, a substantial polygon, a circle, a substantial circle, an oval, a substantial oval, a trapezoid and a substantial trapezoid, are disposed so as to have a portion common to each other. The feeder is connected to the radiating conductor. By this arrangement, it is possible to realize an antenna device, which has an operating frequency band adapted for a wider band than the conventional antennas, provides good impedance matching and has a high degree freedom in design.

Since the antenna body, which comprises the dielectric member, the radiating conductor disposed on or in the dielectric member, and the feeder, has a planar structure, it is possible to provide a surface mount antenna device, wherein the antenna body is mounted to a surface of an insulating substrate, such as a circuit board.

In accordance with the present invention, the exposed portion without the ground conductor disposed thereon may be formed on a portion of a surface of the insulating substrate, and the antenna body may be mounted to a region on the opposite surface of the insulating substrate remote from the exposed portion. In particular, the exposed portion may be formed so as to have contact with an end portion of the insulating substrate, and the antenna body may be disposed in the vicinity of the end portion of the insulating substrate. By this arrangement, the exposed portion of the insulating substrate, which is necessary for the antenna body, can be minimized, and it is possible to provide an antenna device, which is smaller than prior art and has a wider operating frequency band.

When the antenna body is disposed in the vicinity of the end portion of a circuit board, the region for provision of a peripheral circuit can be increased, and the entire communication equipment can be made smaller.

Additionally, when the reflecting member, which reflects a radio wave radiated from the radiating conductor, is disposed away from the insulating substrate, it is possible to provide a high gain antenna device. When the dielectric layer is disposed between the reflecting member and the insulting substrate, and when the air layer is additionally disposed between the dielectric layer and the insulting substrate, it is possible to provide a higher gain antenna device. In particular, by disposing the antenna body having a planar structure, the insulating substrate, the dielectric layer and the reflecting member in parallel or substantially parallel with one another, it is possible to provide a small and high gain antenna device.

BRIEF DESCRIPTION OF THE DRAWINGS

FIG. 27 is a characteristic diagram showing antenna device gain characteristics when the length $L_{41}$ in Example 19 of the antenna device according to the present invention was modified;

FIG. 28 is a characteristic diagram showing a radiation pattern of vertical polarization in Example 20 of the antenna device according to the present invention;

DETAILED DESCRIPTION OF THE INVENTION

Now, the antenna device according to the present invention will be described in detail based on preferred embodiments shown in the accompanying drawings.

Figure 1:
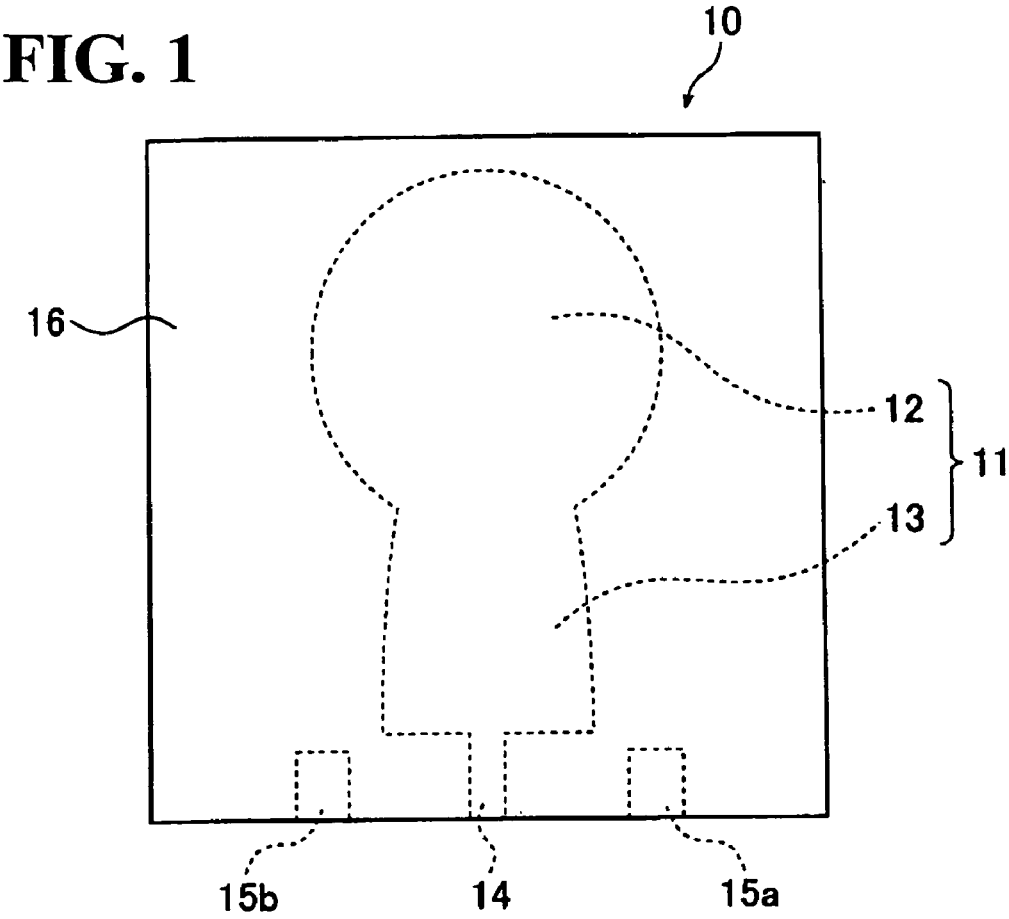
FIG. 1 is a plan view of an embodiment of an antenna body included in the antenna device according to the present invention.
Figure 2:
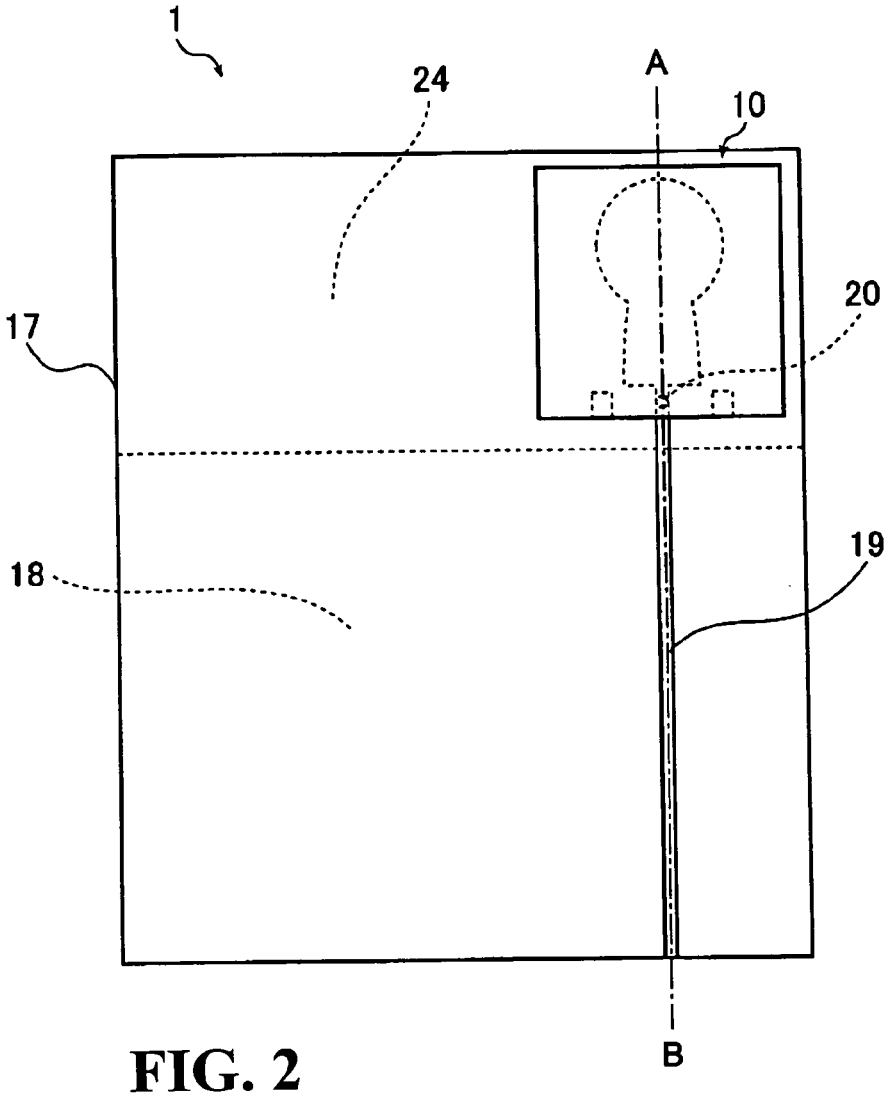
FIG. 2 is a plan view of an embodiment of the antenna device according to the present invention.
Figure 3:
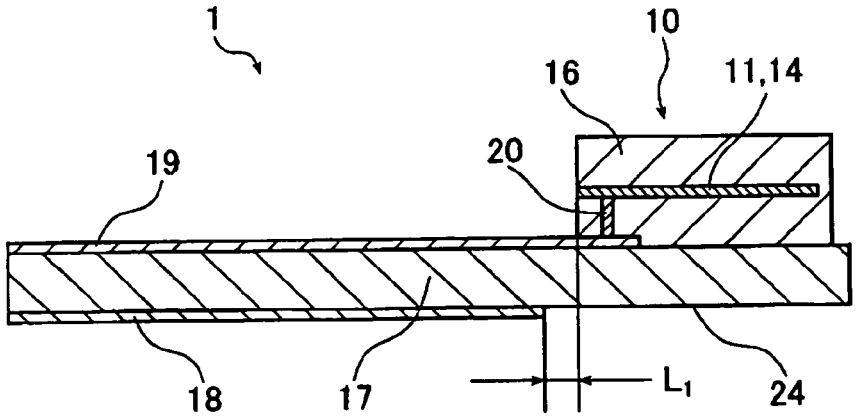
FIG. 3 is a cross-sectional view of the antenna device, taken along line A-B of FIG. 2.

FIG. 1 is a plan view of an antenna body 10, which is included in an antenna device 1 as an embodiment of the antenna device according to the present invention. FIG. 2 is a plan view of the antenna device 1. FIG. 3 is a cross-sectional view of the antenna device 1 shown in FIG. 2, taken along line A-B in FIG. 2.

The antenna body 10 functions as a surface-mount antenna to be mounted to a surface of an insulating substrate 17, such as a circuit board. The antenna body is configured to include a radiating conductor 11, a feeder 14 and a dielectric member 16.

The radiating conductor 11 is a planar metal conductor, which is disposed in the dielectric member 16.

The radiating conductor 11 is configured so that a first forming element 12 having a circular shape and a second forming element 13 having a semi-oval shape with an oval shape partly included are disposed so as to share a portion. The radiating conductor 11 and the feeder 14 are connected together at a peripheral portion of the second forming element 13. The peripheral portion of the second forming element 13, where the connecting position exists, is located on a side of the second forming element 13 remote from the first forming element 12.

As shown in FIG. 3, the feeder 14 is a feeder, which is connected through a via 20 to a signal line 19 of a transmission line disposed on the insulating substrate 17, such as a circuit board.

The radiating conductor 11 and the feeder 14, which are thus configured, are disposed on the same plane in the dielectric member 16.

The dielectric member 16 includes ground patterns 15*a* and 15*b* in order to ensure a potential of 0 at symmetrical positions with respect to the feeder 14 and to effectively provide impedance matching for the antenna. These ground patterns 15*a* and 15*b* are configured so as to be connected to a ground conductor 18 through auxiliary patterns and vias, which are disposed in, e.g., the insulating substrate 17 and are not shown.

Figure 4:
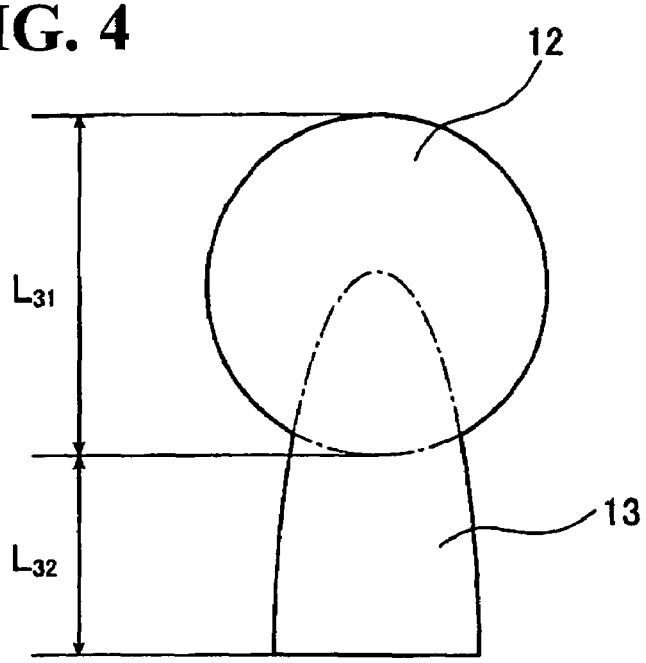
FIG. 4 is a schematic view explaining a shape of the radiating conductor shown in FIG. 1.

FIG. 4 is a schematic view specifically illustrating a shape of the radiating conductor 11.

The first forming element 12 of the radiating conductor 11 is formed in a circular disc shape, and the second forming element 13 of the radiating conductor is formed in a semi-oval shape having a part of an oval shape. In FIG. 4, the portion surrounded by an imaginary line (dashed line) is a portion common to the first forming element 12 and the second forming element 13. This means that when a metal conductor corresponding to the first forming element 12 and a metal conductor corresponding to the second forming element 13 are separately prepared to form the radiating conductor 11, the entire outlines of both of the circular shape and the semi-oval shape do not appear as the outline of the pattern shape of the radiating conductor 11. Even when the first forming element 12 and the second forming element 13 are integrally formed so that both elements are combined so as to share a portion, the entire outlines of the circular shape and the oval shape do not appear as the outline of the pattern shape of the radiating conductor 11.

In the radiating conductor 11 shown in FIG. 4, a portion of the semi-oval shape of the second forming element 13, which has the smallest radius of curvature, is located in the vicinity of the center of the circular shape of the first forming element 12. Additionally, a linear portion of the semi-oval shape of the second forming element 13 (a portion that is obtained by cutting the oval shape in half) is disposed so as to project from the first forming element 12. Further, the radiating conductor 11 is configured so as to be symmetrical about a line connecting the center of the first forming element 12 and the center of the second forming element 13 as the axis of symmetry. The radiating conductor 11 has an edge portion (linear portion) on the axis of symmetry connected to the feeder 14.

In order to delimit the shape of the radiating conductor 11 by a longitudinal length ratio $\alpha$ stated later, a longitudinal length $L_{31}$ of the first forming element and a longitudinal length $L_{32}$ of a portion of the second forming element projected from the first forming element are defined in FIG. 4.

As shown in FIGS. 2 and 3, the antenna body 10 is surface-mounted to the surface of the insulating substrate 17 remote from the ground conductor 18 to form the antenna device 1 serving as an antenna. The insulating substrate 17 has a strip line as the transmission line formed thereon to feed power to the antenna body 10 by, e.g., a micro-strip transmission line.

As shown in FIG. 3, the insulating substrate 17 has the ground conductor formed on one of the surfaces (a lower surface in FIG. 3) and the signal line 19 of the strip line formed on the other surface (an upper surface in FIG. 3), and the antenna body 10 is mounted to the surface of the insulating substrate with the signal line 19 formed thereon. The antenna body 10 has the radiating conductor 11 and the feeder 14 formed in the dielectric member 16, and the radiating conductor 11 and the signal line 19 of the strip line are connected together through the via 20, which is formed in the dielectric member 16. The insulating substrate 17 has an exposed portion 24 without the ground conductor 18 formed on the surface without the ground conductor 18 so as to have contact with an edge portion of the insulating substrate 17 as shown in FIG. 2. The antenna body 10 is mounted to a region on the opposite surface of the insulating substrate, which is opposite to the exposed portion 24 (hereinbelow, referred to as the opposite region of the exposed portion). In this way, the antenna body 10 is disposed in the vicinity of the end portion of the insulating substrate 17.

The antenna device 1 thus figured is formed in such a shape that the first forming element 12 in a circular shape and the second forming element 13 in a semi-oval shape are combined so as to share a portion as stated earlier. By this arrangement, the antenna device can have an improved fractional bandwidth and a wider operating frequency band as shown in Examples stated later.

The radiating conductor of the antenna according to the present invention may be formed in any shape as long as the first forming element, which has a shape selected among a polygon, a substantially polygon, a circle, a substantially circle, an oval and a substantially oval, and the second forming element, which has at least one portion of a shape selected among a polygon, a substantially polygon, a circle, a substantially circle, an oval, a substantially oval, a trapezoid and a substantially trapezoid, are disposed so as to have a portion common to each other.

Although the radiating conductor 11 and the feeder 14 are disposed in the dielectric member 16 in FIG. 3, the radiating conductor and the feeder may be disposed on a surface of the dielectric member 16. The dielectric member 16 may comprise a laminated member. When a laminated member is used, the radiating conductor 11 and the feeder 14 may be disposed in a surface layer of the laminated member or may be disposed in an inner layer, such as a second layer or a third layer. In the latter case, the radiating conductor 11 and the feeder 14 may be disposed so as to be sandwiched by two layers.

Figure 16:
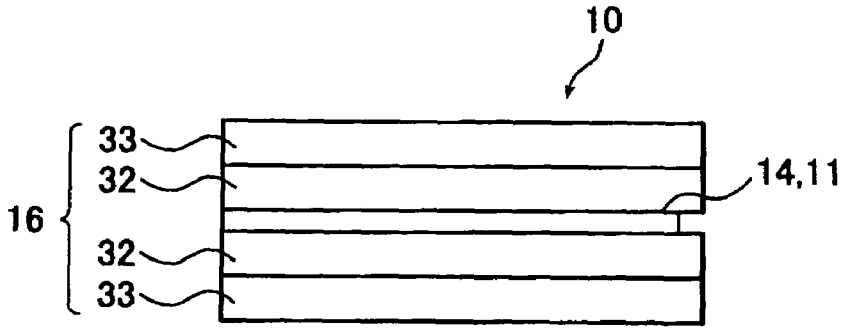
FIG. 16 is a view showing another embodiment of the antenna body employed in the antenna device according to the present invention.

When the dielectric member 16 comprises a laminated member, the laminated member may be formed by laminating similar dielectric layers having a single relative dielectric constant or may be formed by laminating dielectric layers having at least two kinds of different relative dielectric constants as shown in FIG. 16, which is stated later.

By disposing the radiating conductor 11 in the dielectric member 16 to utilize a wavelength shortening effect of a dielectric material, the antenna body 10 can be made small. In this case, it is possible to determine an effective relative dielectric constant in accordance with the position of the radiating conductor 11, the relative dielectric constant of the dielectric member 16 or a combination of at least two kinds of relative dielectric constants of the dielectric member. Thus, it is possible to obtain a wavelength shortening effect according to an effective relative dielectric constant. By properly selecting and adjusting the effective relative dielectric constant, it is possible to provide the antenna body 10 with a wide operating frequency band.

Although the first forming element 12 and the second forming element 13 are disposed on the same plane, the feeder 14, and the ground patterns 15*a* and 15*b* may be disposed on the same plane as or a different plane from the first forming element 12 and the second forming element 13. When the feeder and the ground patterns are disposed on a different plane from the first and second forming elements, the connection between the second forming element 13 and the feeder 14, and the feeder 14 and the signal line 19 of the strip line may be made by vias in the dielectric member 16, an example of the vias being shown in FIG. 3. The feeder 14 may be divided into two parts in a longitudinal direction (the vertical direction in FIG. 1) to form two feeders. In this case, one of the feeders is formed on the same plane as the first forming element 12 and the second forming element 13 and is connected to the second forming element 13. The other feeder is disposed on a different plane from the first forming element 12 and the second forming element 13, is connected to the signal line 19 of the strip line and is connected to the one feeder through the via 20 shown in FIG. 3.

The connection from the signal line 19 of the strip line to the feeder 14 may be made by the via 20 shown in FIG. 3 or by a signal line pattern, which is disposed on an edge of the dielectric member 16. The present invention is not limited to a case wherein the radiating conductor 11 is disposed in the dielectric member 16. The radiating conductor 11, and the ground patterns 15*a* and 15*b* may be disposed on a substrate surface of the insulating substrate 17. In order to additionally obtain a wavelength shortening effect as stated earlier, a dielectric member may be additionally disposed on the radiating conductor 11, which has been disposed on the substrate surface of the insulating substrate 17. When the radiating conductor 11 is disposed on the substrate surface of the insulating substrate 17, a transmission line, such as a micro-strip transmission line for feeding power to the radiating conductor 11, and the radiating conductor 11 may be disposed on the same insulating substrate 17.

The antenna device 1 is configured by surface-mounting the antenna body 10 on the insulating substrate 17 with the ground conductor 18 disposed thereon. The ground conductor 18 may be disposed on a rear surface of the insulating substrate 17 made of, e.g., a dielectric material, by printing. In this case, the transmission line for feeding power to the antenna body 10, e.g., the signal line of a strip line, such as a micro-strip transmission line, may be disposed on a surface of the insulating substrate 17 by printing.

The insulating substrate 17 may comprise a laminated substrate. In this case, the ground conductor 18 may be configured to be disposed in an inner layer of the laminated member, such as a second layer or a third layer, instead of a surface layer, and have an insulating layer disposed thereon.

The transmission line, which is formed on the insulating substrate 17 to feed power to the antenna body 10, is not limited to a micro-strip transmission line and may comprise a coplanar line, wherein the ground conductor and the signal line are disposed on the same surface of the insulating substrate 17. In this case, the ground conductor of the coplanar line functions as the ground conductor 18. The antenna body 10 may be mounted to a surface with the coplanar line disposed thereon or the opposite surface thereof.

The antenna body 10 and the ground conductor 18 may be disposed on the same plane of a single substrate. In this case, it is not necessary to provide an additional member, such as the dielectric member 16 forming the antenna body 10. The antenna device may be configured so that the antenna body 10 is disposed on the opposite region of the exposed portion 24, and the strip line is disposed on the rear surface of the substrate to feed power the antenna body 10 through a via. In other words, the antenna body 10 may be disposed so that the plane; where the ground conductor 18 is disposed, is parallel with the plane, where the radiating conductor 11 of the antenna body 10 is disposed.

A portion of the dielectric member 16, which forms the antenna body 10, or the insulating substrate 17, which has the ground conductor 18 formed thereon, may have a terminal disposed thereon so as to fixedly mount the antenna body 10 to the insulating substrate 17 by, e.g. soldering. By disposing such a terminal at plural positions, it is possible to prevent the antenna body 10 from falling out of the insulating substrate 17 during handling even when the antenna device is employed in communication equipment, such as radio communication equipment. Such a terminal may be employed to connect between the signal line 19 of the strip line formed on the insulating substrate 17 and the feeder 14 formed in the dielectric member 16 by, e.g. soldering for instance. In this case, prevention against falling-out and electrical connection can be simultaneously realized.

In order to dispose such a terminal, the distance $L_1$ between an end of the antenna element 11 (an end of the dielectric member 16) and the ground conductor 18 (see FIG. 3) is normally set in a range from −5 mm to 5 mm in the extending direction of the signal line so as to prevent the antenna device from degrading a characteristic as an antenna. For example, when the distance $L_1$ is −5 mm, the ground conductor 18 and the antenna element 10 overlap in a range of 5 mm in FIG. 3.

The antenna device 1 thus configured may be appropriately employed as an antenna device for transmission and reception of a linearly polarized wave.

Now, transmission and reception characteristics of the antenna device 1 thus configured will be explained.

Figure 5:
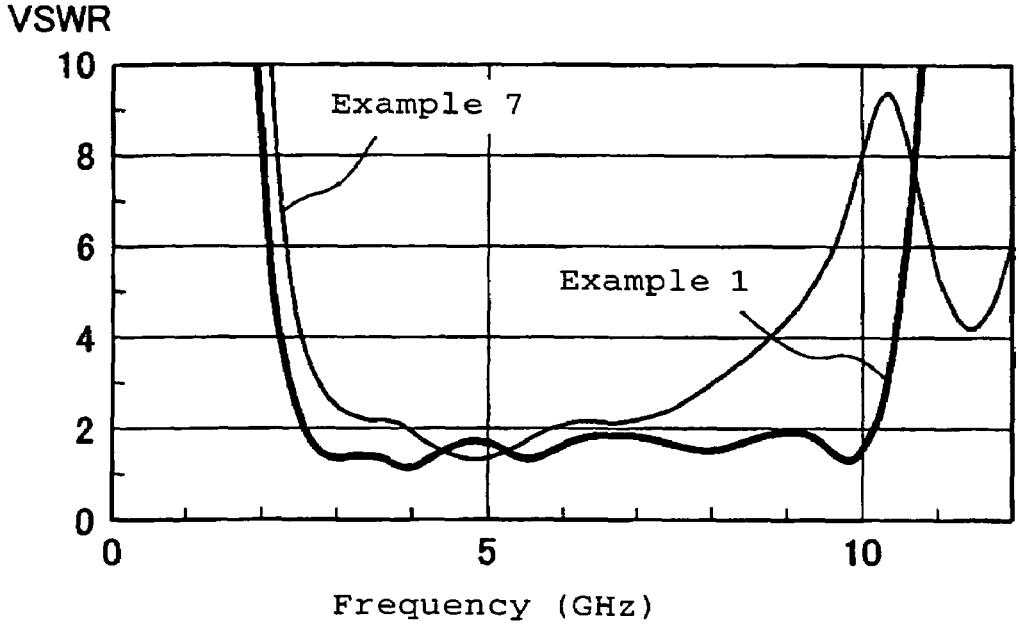
FIG. 5 is a graph showing a frequency characteristic of VSWR in Example 1 of the antenna device according to the present invention.

FIG. 5 is an example of a frequency characteristics of VSWR (Voltage Standing Wave Ratio) of the antenna device 1 shown in FIGS. 2 and 3. In general, when a transmission line is connected to a load, such as an antenna, or connected to, e.g., another transmission line having a different characteristic impedance, a portion of a traveling wave is reflected to generate a backward wave by discontinuity of the connected portion. The backward wave coexists with the traveling wave on the same transmission line to generate a standing wave. VSWR is the ratio of the maximum value to the minimum value of a voltage signal, which appears as the standing wave at that time. This means that as VSWR is closer to 1, the antenna body 10 is provided with better impedance matching with the result that the return loss of the antenna body 10 is minimized to improve characteristics.

In the frequency characteristic of VSWR shown in FIG. 5, VSWR is represented by a vertical axis, and frequencies are represented by a horizontal axis. From the viewpoint stated earlier, the range of frequencies, wherein VSWR is closer to 1, needs to be wide in order to obtain an operating frequency covering a wide range. When VSWR is less than 2.0, it is possible to provide good transmission and reception characteristics. From this viewpoint, by making use of a frequency bandwidth, which has VSWR of less than 2.0 in the frequency characteristic of VSWR, it is possible to determine whether an operating frequency can cover a wide range. Accordingly, it is possible to determine whether an operating frequency band is wide or narrow, finding a fractional bandwidth defined by the following formula (wherein $f_H$ is an upper limit frequency having VSWR of less than 2, and $f_L$ is a lower limit frequency having VSWR of less than 2:

$$\text{Fractional bandwidth}=2\cdot(f_H-f_L)/(f_H+f_L)\times 100(\%)$$

It is meant that a wider fractional bandwidth has a wider operating frequency bandwidth.

The frequency characteristics of VSWR in the antenna device 1 shown in FIGS. 2 and 3 will be described later, referring to various examples.

The antenna device according to the present invention has a fractional bandwidth of not less than 40% when using a frequency bandwidth having VSWR of less than 2.0. The antenna device according to the present invention preferably has a fractional bandwidth of not less than 75% when using a frequency bandwidth having. VSWR of less than 2.2, more preferably has a fractional bandwidth of not less than 85% when using a frequency bandwidth having VSWR of less than 2.4, particularly preferably has a fractional bandwidth of not less than 90% when using a frequency bandwidth having VSWR of less than 2.6, and most preferably has a fractional bandwidth of not less than 100% when using a frequency bandwidth having VSWR of less than 3.0.

Now, the antenna devices according to other embodiments of the present invention will be described.

Figure 6:
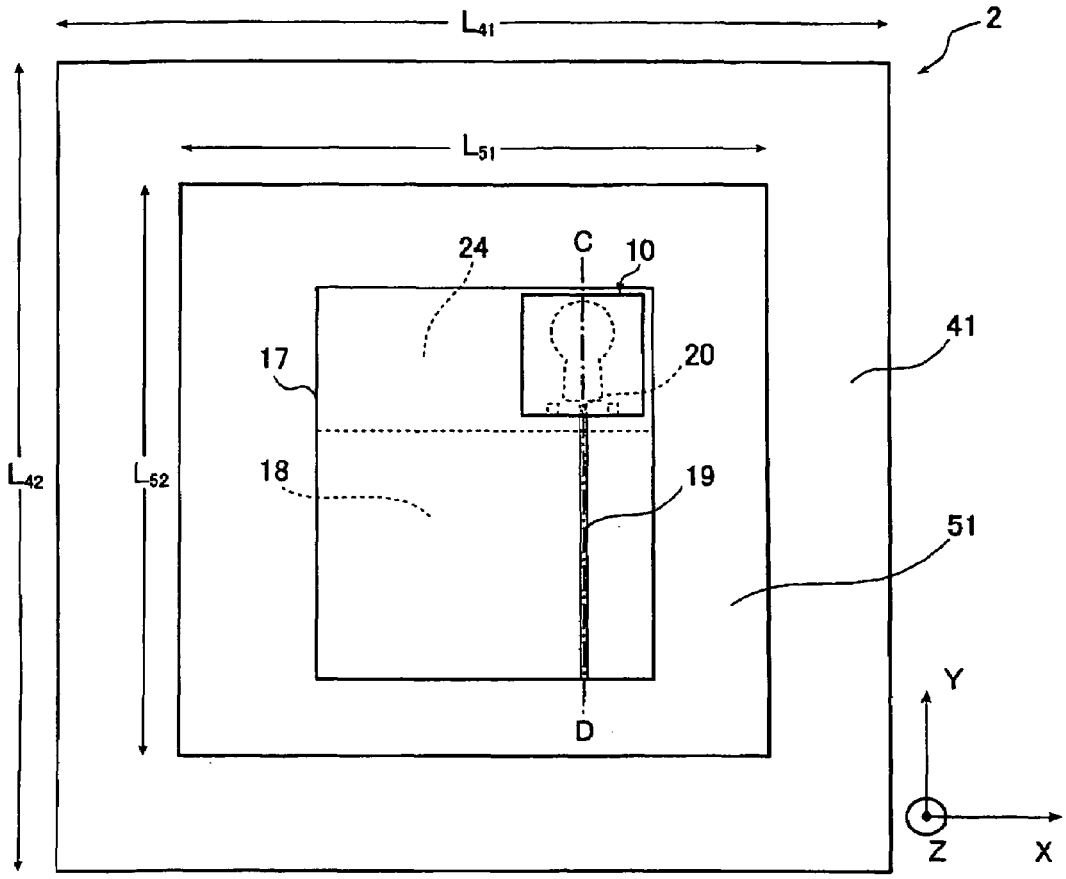
FIG. 6 is a plan view of another embodiment of the antenna device according to the present invention.
Figure 7:
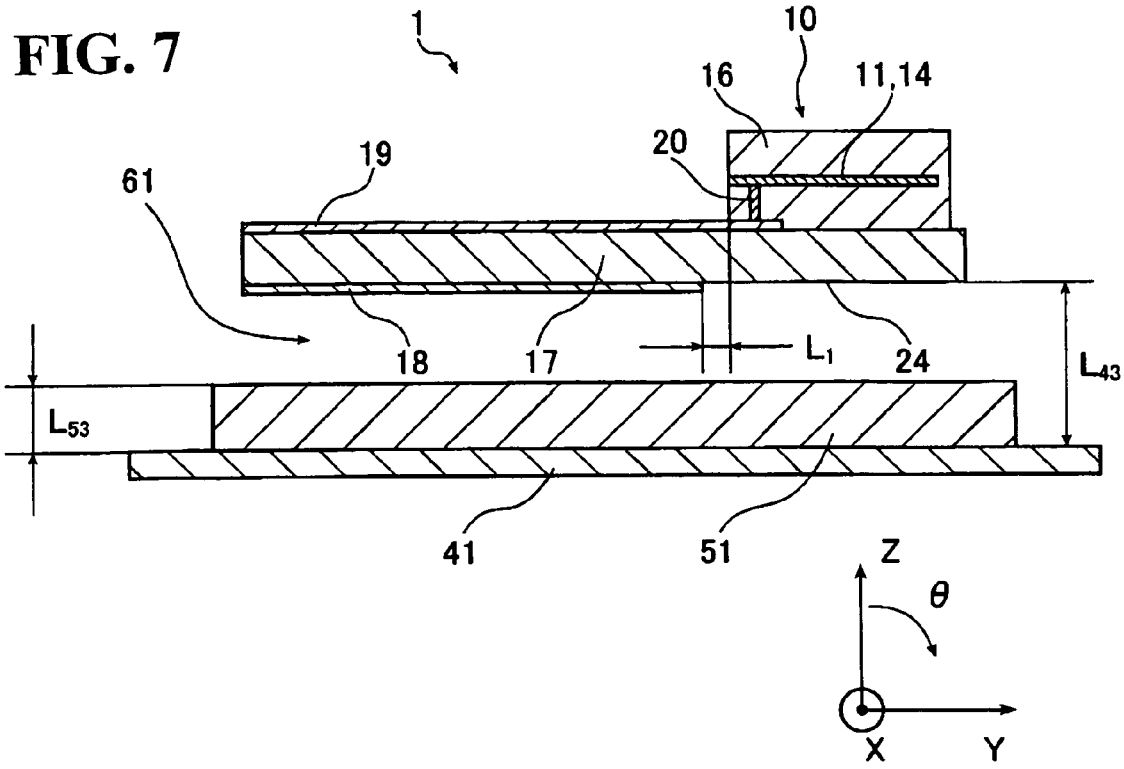
FIG. 7 is a cross-sectional view of the antenna device, taken along line C-D of FIG. 6.

FIGS. 6 and 7 show an antenna device 2, wherein a reflector 41 and a dielectric layer 51 are disposed in the structure of the antenna device 1 shown in FIG. 2.

FIG. 6 is a plan view of the antenna device 2, and FIG. 7 is a cross-sectional view of the antenna device 2 shown in FIG. 6, taken along line C-D in FIG. 6. The antenna device 2 is an antenna device, which makes at least one of transmission and reception.

In the antenna device 2, the antenna body 10 is mounted to a surface of the insulating substrate 17, such as a circuit board, as in the antenna device 1. Additionally, the reflector 41 and the dielectric layer 51 are disposed along the insulating substrate 17 on the side of the surface of the insulating substrate 17 with the ground conductor 18 disposed thereon.

The antenna body 10 is a surface-mount antenna, which is mounted to a surface of the insulating substrate 17 as stated earlier. Explanation of the antenna body 10 and the insulating substrate 17 is omitted since both parts have been stated earlier.

The reflector 41 comprises a flat metal plate and has a function to improve a gain by providing a radio wave radiating from the antenna body 10 with a sharp radiation pattern in a normal line direction of a surface of the reflector 41. A radio wave radiated from the antenna body 10 is reflected in a direction of Z since the reflector 41 is disposed along the insulating substrate 17 as shown in FIGS. 6 and 7. The surface of reflector is not limited to a planar shape. A reflector, which has a surface formed with a curved surface, such as a cylinder, a portion of a cylinder, a sphere or a portion of a sphere, is also acceptable. For example, when the reflector has a surface formed so as to have a shape comprising a portion of a cylinder, the radiation pattern of a radio wave can be enhanced in a single direction on a portion along a linear part of the reflector surface, and the radiation pattern of a radio wave can be made broad on a portion represented by a curved part of a reflector surface.

The material for the reflector 41 is not limited to metal. The reflector may be made of any material, which reflects a radio wave. For example, it is acceptable to employ one wherein a transparent conductive film is disposed on a dielectric substrate, such as a glass plate. It is also acceptable to employ an EBG (Electromagnetic Band Gap) structure, which functions as an artificial magnetic conductor.

The dielectric layer 51 is disposed on the surface of the reflector 41.

The dielectric layer 51 comprises a dielectric member, which is provided between the insulating substrate 17 and the reflector 41. The dielectric layer has a function to provide the antenna device 2 with a high gain by being employed along with the reflector 41. Although the dielectric layer 51 is disposed on the surface of the reflector 41 in this embodiment, the dielectric layer may be provided at a desired position between the insulating substrate 17 and the reflector 41 in the present invention. However, in order to maintain a high gain for a low frequency in the operating frequency band of the antenna device 2, it is preferred that the dielectric layer 51 be disposed on the surface of the reflector 41 so that the insulating substrate 17, an air layer 61, the dielectric layer 51 and the reflector 41 are provided in this order. Although the relative dielectric constant of the dielectric layer 51 is not particularly limited, the relative dielectric constant preferably ranges from 1.5 to 20, more preferably ranges from 2 to 10.

Although the reflector 41 is provided along the insulating substrate 17 in this embodiment, the reflector 41 is not necessarily provided along the insulating substrate 17 in the present invention. The direction of the reflector 41 and the dielectric layer 51 to the insulating substrate 17 may be modified according to a direction to reflect a radio wave. For example, in order to obtain the maximum radiation intensity of a radio wave in a direction inclined at an angle of $\theta=20$ deg from the Z-axis toward the Y-axis in FIGS. 6 and 7, the reflector 41 and the dielectric layer 51 may be disposed so as to be inclined at an angle of 20 deg toward the Y-axis direction with respect to the insulating substrate 17. In order to obtain the maximum radiation intensity of a radio wave in the X-axis direction in FIGS. 6 and 7, the reflector 41 and the dielectric layer 51 may be disposed so as to have surfaces facing in the X-axis direction in FIGS. 6 and 7, i.e., in a direction perpendicular to the insulating substrate 17.

It is preferred that the insulating substrate 17, the reflector 41 and the dielectric layer 51 be disposed parallel or substantially parallel with one another. By this arrangement, the antenna device can be configured in a substantially planar shape and can be provided as a small size antenna device. The reflector 41 and the dielectric layer 51 may be disposed on the side of the insulating substrate 17 remote from the antenna body 10 or the same side of the insulating substrate as the antenna body 10.

In FIG. 6, the shape of the reflector 41 is defined by representing the length of the reflector 41 in a transverse direction (X direction) and the length of the reflector in a vertical direction (Y direction) by $L_{41}$ and $L_{42}$, respectively. In FIG. 7, the position where the reflector 41 is disposed is defined as a position away from the insulating substrate 17 by a distance of $L_{43}$.

The dimensions of the reflector 41 (lengths $L_{41}$ and $L_{42}$) are set so that the flat metal plate can function as a reflection plate for a radio wave. When the reflector 41 has smaller dimensions than a certain value, the reflector cannot function as a reflection plate. The lengths $L_{41}$ and $L_{42}$ are set so that the reflector 41 can perform the required function in a frequency band in a wide band to provide the antenna device 2 with a characteristic having a high gain over the wide band. For example, it is sufficient that the length $L_{41}$ and/or the length $L_{42}$ is 30 mm or longer in the antenna device 2. Although it is preferred that the length $L_{41}$ of the reflector 41 in the transverse direction and/or the length $L_{42}$ of the reflector in the vertical direction be equal to or longer than the lengths of the insulating substrate 17 in the corresponding direction, it is sufficient that at least one of the length $L_{41}$ of the reflector 41 in the vertical direction and the length $L_{42}$ of the reflector in the vertical direction is equal to or longer than the length of the insulating substrate 17 in the corresponding direction. For example, even if the length $L_{41}$ of the reflector 41 in the transverse direction is shorter than the length of the insulating substrate 17 in the transverse direction, it is sufficient that the length $L_{42}$ of the reflector 41 in the vertical direction is longer than the length of the insulating substrate 17 in the vertical direction. It is preferred that the length $L_{41}$ and/or the length $L_{42}$ be 1.3 times or more the length of the insulating substrate 17 in the transverse direction and/or the length of the insulating substrate 17 in the vertical direction, e.g., 40 mm or longer.

By adjusting the distance $L_{43}$, the reflector 41 can perform the required function in a frequency band in a wide band to provide the antenna device with a high gain over a wide band. The distance $L_{43}$ in the antenna device 2 preferably ranges from 5 to 25 mm, more preferably ranges from 7 to 22 mm. In both ranges, the antenna device exhibits high gain characteristics in a wide operating frequency band from 3 to 5 GHz.

The shape of the dielectric layer 51 is defined by representing the length of the dielectric layer 51 in the transverse direction and the length of the dielectric layer in the vertical direction by $L_{51}$ and $L_{52}$, respectively, in FIG. 6 and by representing the thickness of the dielectric layer by $L_{53}$ in FIG. 7.

When the dielectric layer 51 has a smaller size than a certain size, the gain of the antenna device 2 is lowered. The dielectric layer can function so as to provide the antenna device 2 with high gain characteristics in a frequency band in a wide band by setting the length $L_{51}$ and the length $L_{52}$ in a certain range.

For example, it is sufficient that the length $L_{51}$ and/or the length $L_{52}$ is 30 mm or longer in the antenna device 2. It is preferred that the length $L_{51}$ of the dielectric layer 51 in the transverse direction and/or the length $L_{52}$ of the dielectric layer in the vertical direction be equal to or longer that the length of the insulating substrate 17 in the corresponding direction. However, it is sufficient that at least one of the length $L_{51}$ of the dielectric layer 51 in the transverse direction and the length $L_{52}$ of the dielectric layer in the vertical direction is equal to or longer than the length of the insulating substrate 17 in the corresponding direction. For example, even if the length $L_{51}$ of the dielectric layer 51 in the transverse direction is shorter than the length of the insulating substrate 17 in the transverse direction, it is sufficient that the length $L_{52}$ of the dielectric layer 51 in the vertical direction is longer than the length of the insulating substrate 17 in the vertical direction. It is preferred that the length $L_{51}$ and/or the length $L_{52}$ is 1.3 times or more the length of the insulating substrate 17 in the transverse direction and/or the length of the insulating substrate in the vertical direction, e.g., 40 mm or longer.

By setting the thickness $L_{53}$ of the dielectric layer 51 in a certain range, the dielectric layer can function so as to provide the antenna device 2 with high gain characteristics over a frequency band in a wide band.

The range of the thickness $L_{53}$ of the dielectric layer 51 will be described later.

Now, characteristics of the antenna device according to the present invention will be specifically described based on various examples.

EXAMPLE 1

EXAMPLE

Figure 33:
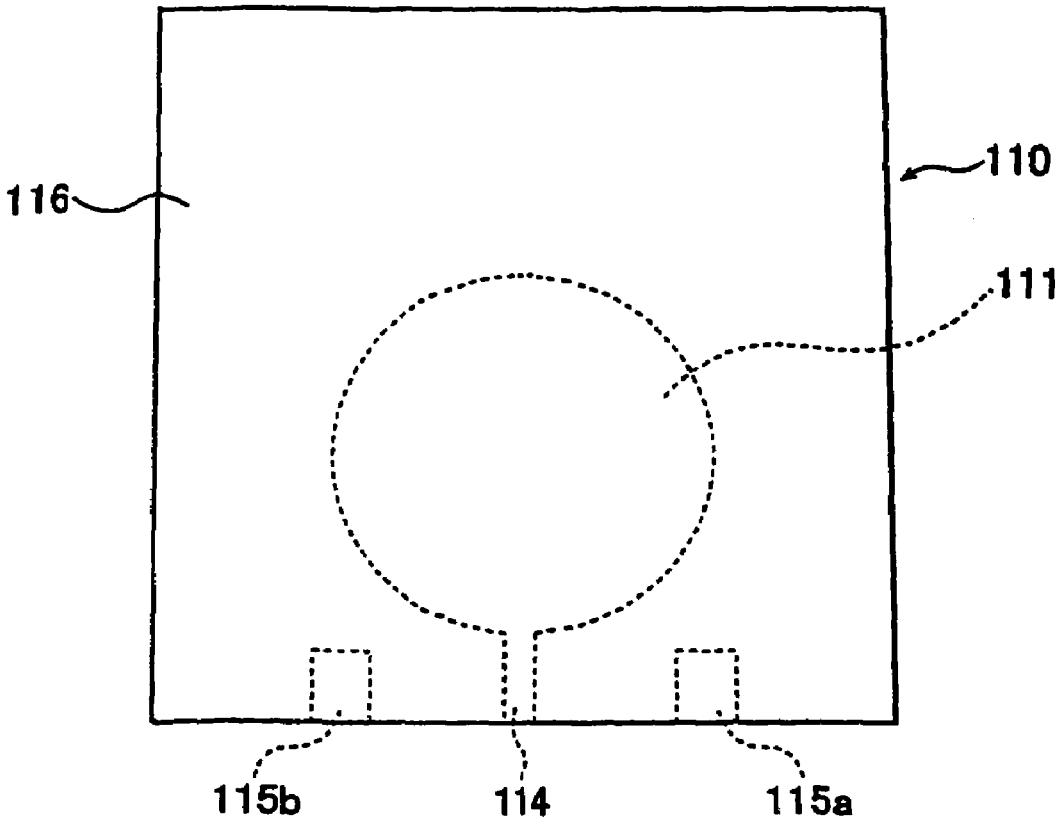
FIG. 33 PRIOR ART
FIG. 33 is a view showing a conventional antenna.

FIG. 5 is a graph showing a frequency characteristic of VSWR in the antenna device 1 in Example 1, which will be explained below. FIG. 5 also shows a frequency characteristic of VSWR in Example 7 (comparative example), wherein an antenna, which is different from one in Example 1, is shown in FIG. 33 as a comparative example and will be described later, was employed. The frequency characteristics are found in accordance with electromagnetic field simulation by the FI (Finite-Integration) method.

Example 1 is an example wherein the antenna device 1 having the antenna body 10 shown in FIG. 1 was employed. Example 7 employs an antenna device wherein an antenna body 110, which comprises a circular radiating conductor 111 as shown in FIG. 33, is employed instead of the antenna body 10 shown in FIG. 1. Details of the antenna device will be described later.

In each of Example 1 and Example 7, the antenna body 10 or 110 is mounted to one of both surfaces of the insulating substrate 17, and the ground conductor 18 is disposed on the other surface as shown in FIG. 2.

Table 1 shows the dimensions of main parts of the antenna device 1 in Example 1 along with those in Examples 2 to 7, which will be stated later. The words "length" and "width" in items of "ground pattern", "dielectric member", "insulating substrate" and "ground conductor" in Table 1 mean the length in the vertical direction and the length in the transverse direction in FIG. 2 and FIG. 6, respectively.

TABLE 1

Figure 10:
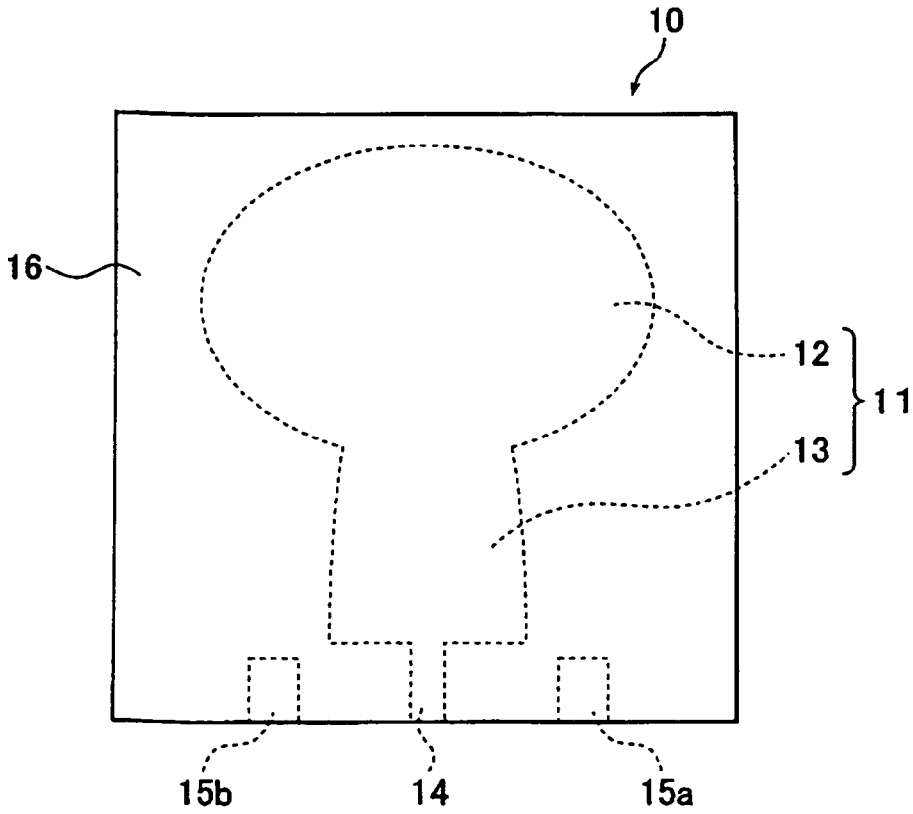
FIG. 10 is a view showing another embodiment of the antenna body employed in the antenna device according to the present invention.
Figure 11:
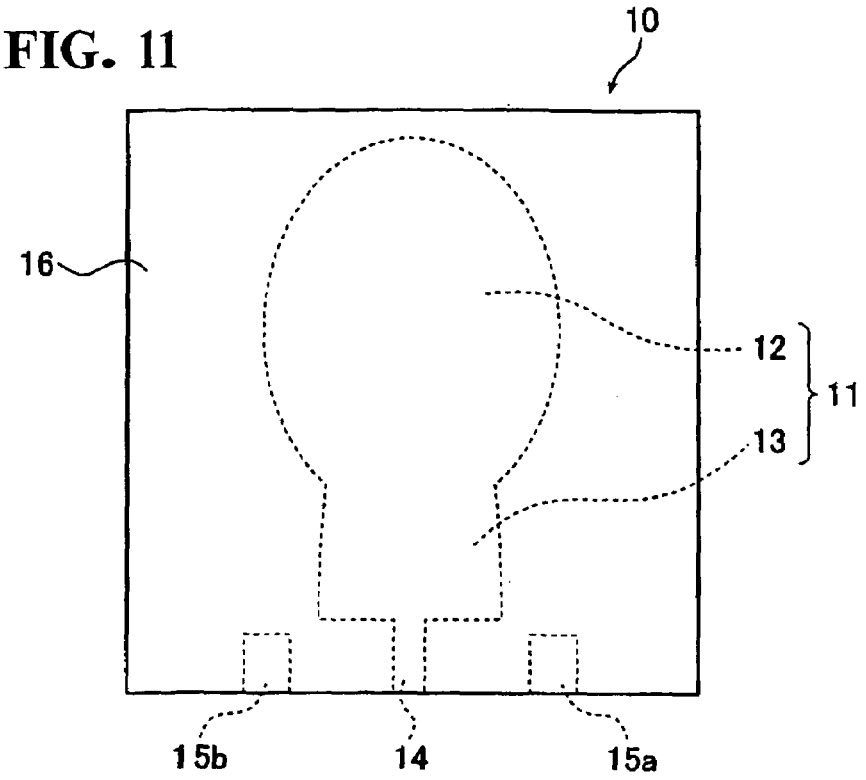
FIG. 11 is a view showing another embodiment of the antenna body employed in the antenna device according to the present invention.
Figure 12:
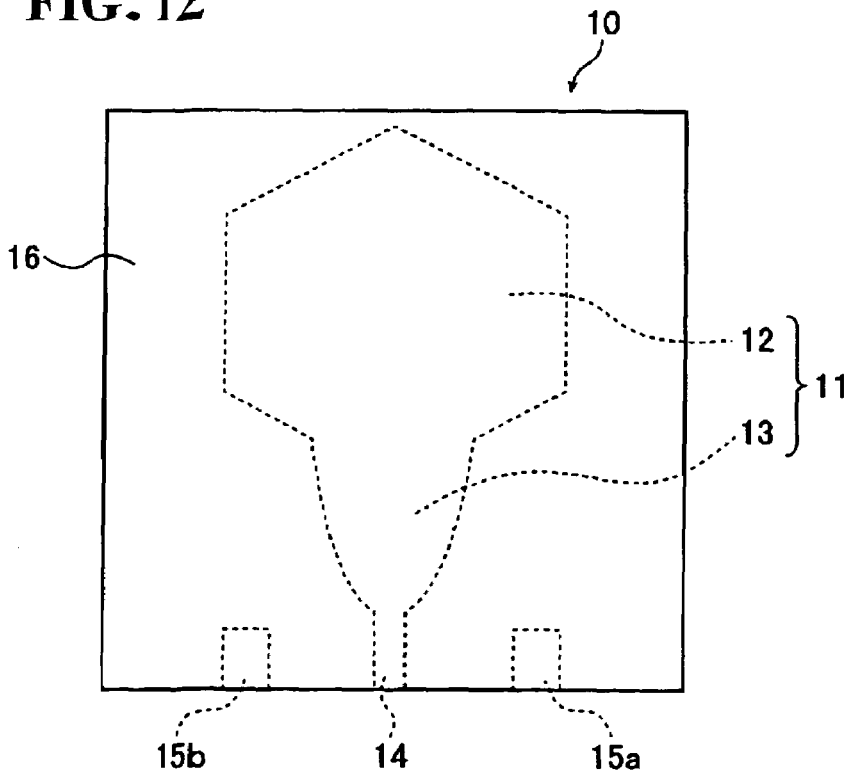
FIG. 12 is a view showing another embodiment of the antenna body employed in the antenna device according to the present invention.

| | Ex. 1 | Ex. 2 | Ex. 3 | Ex. 4 | Ex. 5 | Ex. 6 | Ex. 7 |
|---|---|---|---|---|---|---|---|
| Structural view showing antenna body | FIG. 1 | FIG. 1 | FIG. 1 | FIG. 10 | FIG. 11 | FIG. 12 | FIG. 33 |
| First forming element | Circular shape Diameter: 6 mm | Circular shape Diameter: 8 mm | Circular shape Diameter: 8 mm | Oval shape (Major axis radius: 4 mm Minor axis radius: 3 mm) | Oval shape (Major axis radius: 4 mm Minor axis radius: 3 mm) | Hexagonal shape (Length: 6 mm Width: 5 mm) | Circular shape Diameter: 6 mm |
| Second forming element | Semi-oval shape (Major axis radius: 6 mm Minor axis radius: 1 mm) | Semi-oval shape (Major axis radius: 6 mm Minor axis radius: 1 mm) | Semi-oval shape (Major axis radius: 6 mm Minor axis radius: 1 mm) | Semi-oval shape (Major axis radius: 6 mm Minor axis radius: 1 mm) | Semi-oval shape (Major axis radius: 6 mm Minor axis radius: 1 mm) | Semi-oval shape (Major axis radius: 6 mm Minor axis radius: 1 mm) | — |
| Ground pattern (length × width) | 1 mm × 0.7 mm | 1 mm × 3 mm | 1 mm × 2.5 mm | 1 mm × 0.7 mm | 1 mm × 0.7 mm | 1 mm × 0.7 mm | 1 mm × 0.7 mm |
| Dielectric member (length × width) | 15 mm × 13 mm | 12 mm × 10 mm | 12 mm × 10 mm | 15 mm × 13 mm | 15 mm × 13 mm | 12 mm × 12 mm | 15 mm × 13 mm |
| Insulating substrate (length × width) | 45 mm × 30 mm | 42 mm × 30 mm | 40 mm × 30 mm | 45 mm × 30 mm | 45 mm × 30 mm | 32 mm × 20 mm | 45 mm × 30 mm |
| Ground conductor (length × width) | 30 mm × 30 mm | 30 mm × 30 mm | 27 mm × 30 mm | 30 mm × 30 mm | 30 mm × 30 mm | 20 mm × 20 mm | 30 mm × 30 mm |

As shown in FIG. 5, the frequency characteristic in Example 1 has a fractional bandwidth of 120% while the frequency characteristic in Example 7 has a fractional bandwidth of 40%. Example 1 has a wider fractional bandwidth and a wider operating frequency band. Additionally, in Example 1, the value of VSWR is closer to 1, and the return loss in the antenna is reduced to improve the transmission and reception characteristics as the antenna. Thus, the radiating conductor 11, which is formed so that the first forming element 12 and the second forming element 13 have a common portion, can not only have the fractional bandwidth mode wider but also achieve optimum impedance matching over a wide band. In other words, by providing the radiating conductor 11 with the second forming element 13, it is possible not only to improve the fractional bandwidth but also to provide good impedance matching.

This reveals that it is possible to provide optimum impedance matching over a wide band by appropriately adjusting the shape of the second forming element 13 in accordance with the size of the first forming element 12 in the radiating conductor 11. Additionally, it is possible to provide good matching in a wider frequency band by appropriately adjusting the major axis radius and the minor axis radius of the oval shape in the second forming element 13.

EXAMPLE 2

EXAMPLE

Figure 8:
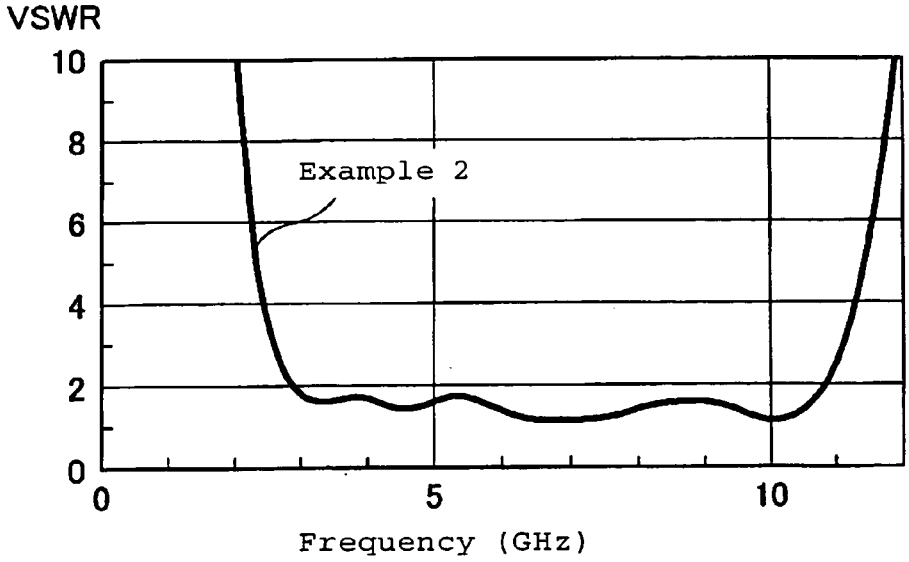
FIG. 8 is a graph showing a frequency characteristic of VSWR in Example 2 of the antenna device according to the present invention.

FIG. 8 is a graph showing a frequency characteristic of VSWR of the antenna device 1 in Example 2. This antenna device 1 is an antenna device, which includes an antenna body 10 shown in FIG. 1 and having different dimensions from the antenna body in Example 1, and which had the antenna body 10 mounted to an insulating substrate 17. The frequency characteristic shown in FIG. 8 is found in accordance with electromagnetic field simulation by the FI method. The dimensions of major parts of the antenna device 1 in Example 2 are shown in Table 1.

Additionally, the length of the feeder 14 in Example 2 is 0.7 mm. The thickness of the dielectric member 16 is 1.2 mm, and the radiating conductor 11 is disposed in the dielectric member 16. The dielectric member 16 is configured so that the radiating conductor 11 is disposed in two sets of dual dielectric layers (first dielectric layer 32 and second dielectric layer 33) having different relative dielectric constants as shown in FIG. 16. The first dielectric layer 32 in each pair has a relative dielectric constant of 22.7, and the second dielectric layer 33 in each pair has a relative dielectric constant of 6.6.

The fractional bandwidth found from the frequency characteristic of VSWR shown in FIG. 8 is 115%, which has a wider operating frequency band in comparison with the fractional bandwidth of 40% in Example 7 shown in FIG. 5.

EXAMPLE 3

EXAMPLE

Figure 9:
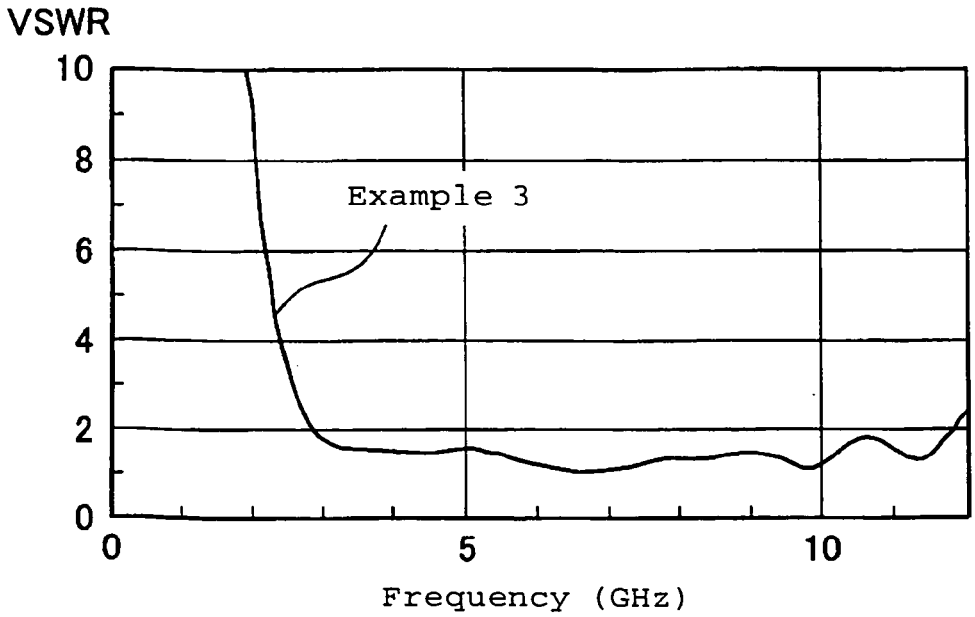
FIG. 9 is a graph showing a frequency characteristic of VSWR in Example 3 of the antenna device according to the present invention.

FIG. 9 is a graph showing measurement results of a frequency characteristic of VSWR of an antenna, which was fabricated in substantially the same structure as the one in Example 2 stated earlier.

Specifically, the dielectric member 16 is formed by two sets of dual dielectric layers (first dielectric layer 32 and second dielectric layer 33) having different relative dielectric constants as in Example 2. In the dielectric member 16, the radiating conductor 11 and the feeder 14, which formed the antenna body 10, were disposed on a single plane in a substantially central portion in the thickness direction of the dielectric member 16. The first dielectric layer 32 has a relative dielectric constant of 22.7 and a thickness of 0.3 mm, and the second dielectric layer 33 has a relative dielectric constant of 7.6 and a thickness of 0.3 mm.

The dimensions of main parts of the antenna device 1 in Example 3 are shown in Table 1.

With respect to other dimensions, the dielectric member 16 has a thickness of 1.2 mm as a whole. The insulating substrate 17 has a thickness of 0.8 mm. Both forming elements were disposed so that a portion of the semi-oval shape of the second forming element 13, which had the smallest radius of curvature, was located in the vicinity of the center of the circular shape of the first forming element 12, and that a linear portion of the semi-oval shape of the second forming element 13 (a portion that is obtained by cutting the oval shape in half) was disposed so as to project from the first forming element 12. The feeder 14, which is connected to a peripheral portion on a side of the second forming element 13 as seen from the first forming element 12, has a length of 0.9 mm and a width of 0.2 mm. The other peripheral portion of the feeder 14, which is not connected to the second forming element 13, is located at a position away from an end of the dielectric member 16 (a lower end of the dielectric member 16 in FIG. 1) by a length of 0.8 mm.

Additionally, the ground patterns 15*a* and 15*b* were disposed on a side of the dielectric member 16 in contact with the insulating substrate 17, and an unshown feeding pad is disposed between the ground patterns 15*a* and 15*b*. The unshown feeding pad has dimensions of 1.1 mm in length and 1.4 mm in width. The distance between the unshown feeding pad and each of the ground patterns 15*a* and 15*b* is 0.5 mm. The feeding pad was connected to an end of the feeder 14 through the via 20.

The insulating substrate 17 having the ground conductor 18 was fabricated by employing a resin substrate, which had a thickness of 0.8 mm and had both sides covered with copper foil having a thickness of 0.018 mm (R-1766T manufactured by Matsushita Electric Works, Ltd. and having a relative dielectric constant of 4.7). The insulating substrate 17 had one of the surfaces formed with the signal line 19 and the other surface formed with the ground conductor 18, and the dielectric member 16 was mounted to an end of the surface of the insulating substrate 17 with the signal line 19 formed thereon (an upper right end of the insulating substrate 17 shown in FIG. 2).

The signal line 19 of the transmission line is formed as a signal line of a micro-strip transmission line and has a transverse width of 1.4 mm. Conductor patterns, such as the ground conductor 18, the signal line 19 and an unshown connection pad (a pad connected to the feeding pad), were disposed by etching. These conductors were subjected to gold-flush treatment, and the surface portions of the conductors except for the connection pad were covered with a solder-resist.

A lead-free cream (M705 manufactured by Senju Metal Industry Co., Ltd.) was printed at the position of the connection pad of the insulating substrate 17 by using a metal mask. The dielectric member 16 was located at a certain position and was put on the insulating substrate 17, and the dielectric member 16 and the insulating substrate 17 were heated at a temperature of 250° C. to be melt-bonded together by soldering. Thus, the signal line 19 was connected to the feeding pad of the dielectric member 16, and the ground patterns 15*a* and 15*b* were connected to the ground conductor 18 through connection pads and vias, which were formed at the insulating substrate 17 but not shown.

Measurements of VSWR were conducted in connection with the antenna device thus fabricated, and measurement results shown in FIG. 9 were obtained. In this case, the fractional bandwidth is 120%. It is revealed that the antenna device has a wider operating frequency bandwidth in comparison with the antenna device in Example 7, which has a fractional bandwidth of 40% as shown in FIG. 5.

Additionally, when an antenna device, which had the second forming element 13 formed in a rectangular shape, was fabricated, it was affirmed that this antenna device also had a similar fractional bandwidth.

EXAMPLES 4, 5 and 6

EXAMPLES

FIGS. 10 to 12 are views showing Examples 4 to 6, wherein the shape of the radiating conductor 11 is modified.

An antenna device 1 employing a radiating conductor 11 shown in FIG. 10 is represented as Example 4, an antenna device 1 employing a radiating conductor 11 shown in FIG. 11 is represented as Example 5, and an antenna device 1 employing a radiating conductor 11 shown in FIG. 12 is represented as Example 6.

The dimensions of main parts of the antenna devices 1 in Example 4 shown in FIG. 10, Example 5 shown in FIG. 11 and Example 6 shown in FIG. 12 are shown in Table 1.

In each of Example 4 and Example 5, the radiating conductor 11 is disposed by combining a first forming element 12 and a second forming element 13 so that both forming elements shares a portion having the smallest radius of curvature in the semi-oval shape of the second forming element 13. The first forming element 12 in Example 4 is disposed so as to have the major axis extending in a transverse direction in FIG. 10, and the first forming element 12 in Example 5 is disposed so as to have the major axis extending in a vertical direction in FIG. 11.

From now on, explanation will be made, making such a distinction that the antenna body 10 shown in FIG. 10 had the major axis of the first forming element extending the transverse direction in this figure, and the antenna body 10 shown in FIG. 11 had the major axis of the first forming element extending the vertical direction in this figure.

In FIG. 12, the radiating conductor 11 had a first forming element 12 formed in a hexagonal shape and a second forming element 13 formed in a semi-oval shape, and a portion having a small radius of curvature in the semi-oval shape of the second forming element 13 is disposed so as to be connected with the feeder 14.

The length and the width in the hexagonal shape (item of the first forming element 12) in Example 6 in Table 1 mean the length in the vertical direction in FIG. 12 and the length in the transverse direction in FIG. 12, respectively. The semi-oval shape of the second forming element 13 is obtained by cutting an oval shape along the minor axis.

Figure 13:
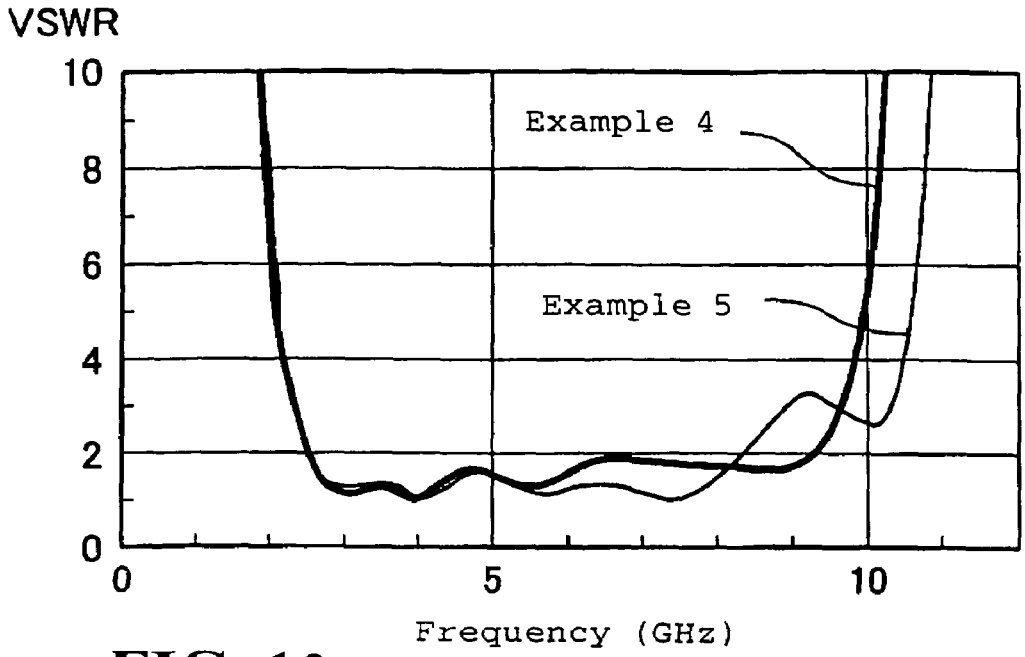
FIG. 13 is a graph showing frequency characteristics of VSWR in Examples 4 and 5 of the antenna device according to the present invention.

FIG. 13 shows frequency characteristics of VSWR in Examples 4 and 5. The frequency characteristics are found in accordance with electromagnetic field simulation by the FI method. FIG. 13 shows that Example 4 and Example 5 has substantially the same fractional bandwidth as Example 1, and that the operating frequency bandwidth in each of the Examples is wider than Example 7 having a fractional bandwidth of 40% as shown in FIG. 5.

Figure 14:
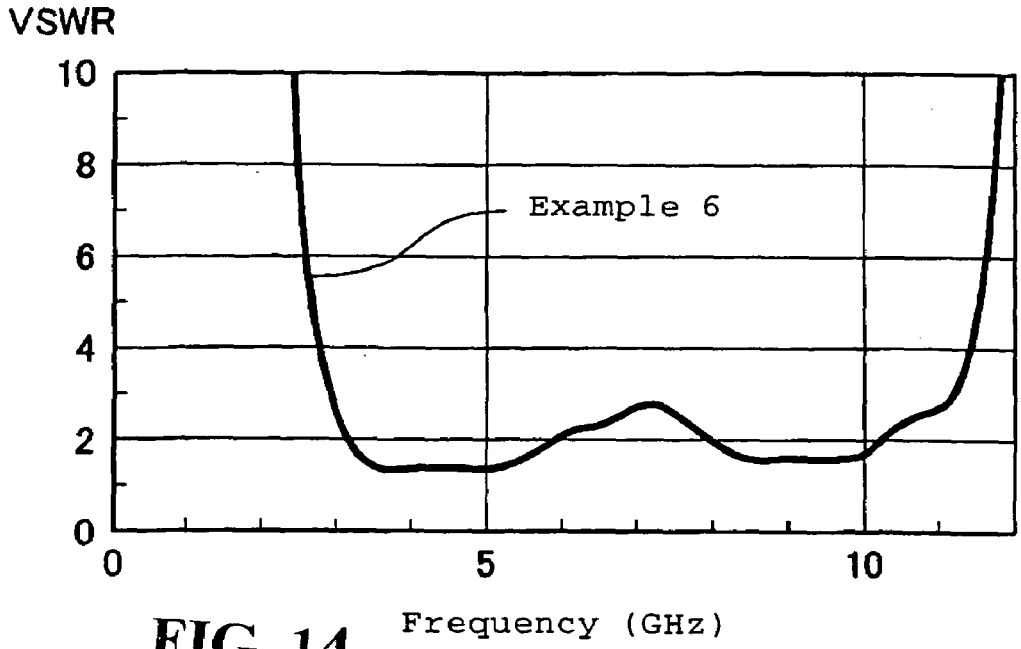
FIG. 14 is a graph showing a frequency characteristic of VSWR in Example 6 of the antenna device according to the present invention.
Figure 31:
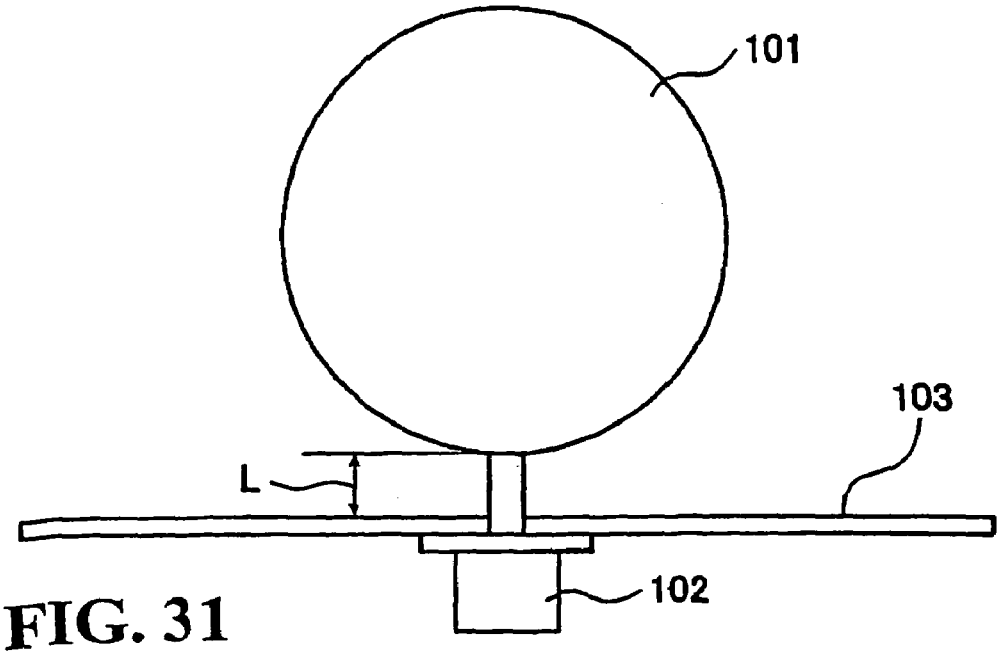
FIG. 31 PRIOR ART
FIG. 31 is a view showing a conventional disc monopole antenna.
Figure 32:
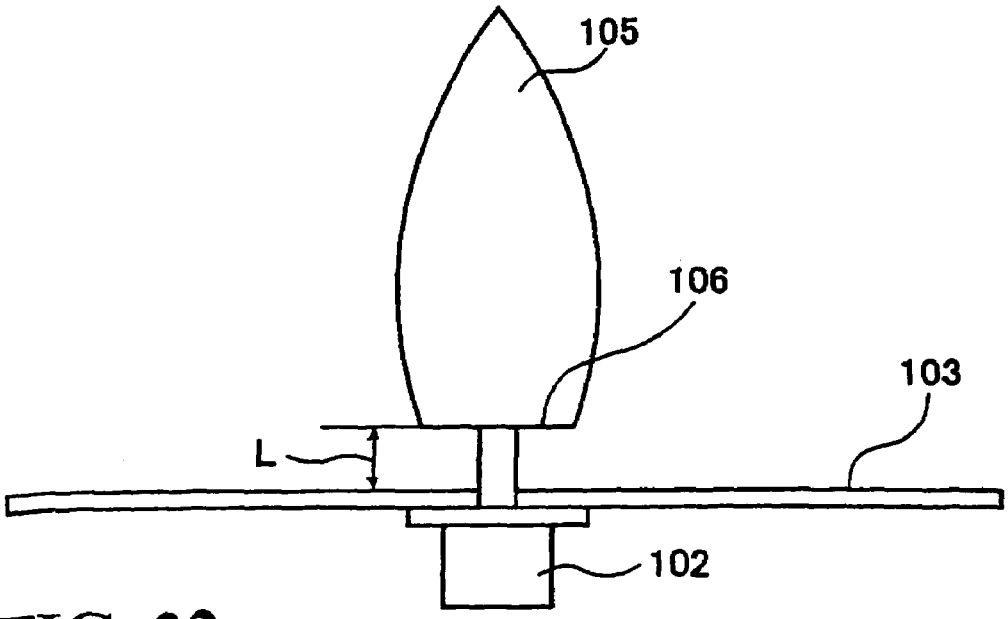
FIG. 32 PRIOR ART
FIG. 32 is a view showing a conventional monopole antenna.

Additionally, FIG. 14 is a graph showing a frequency characteristic of VSWR in Example 6. FIG. 14 reveals that a frequency bandwidth of this example, wherein VSWR is 3 or below, is substantially the same as the frequency bandwidth of Example 1 shown in FIG. 5, and that this example has a fractional bandwidth of about 61%. This means that when the first forming element 12 has a shape selected among a circular, an oval shape, a polygonal, such as a triangle, a square, a hexagonal or an octagon, a substantial circle, a substantial oval, or a substantial polygonal, and when the second forming element 13 has at least one portion formed in a shape selected among a circle, an oval, a polygonal, a trapezoid, a substantial circle, a substantial oval, a substantial polygonal, or a substantial trapezoid, it is possible to obtain a fractional bandwidth of 80% or more in any combination. By such a combination, it is possible to realize an operating frequency characteristic in a wide band, which has an improved fractional bandwidth in comparison with the antennas having a circular forming element as shown in FIGS. 31 to 33. In order to obtain a better operating frequency in a wide band, it is preferred that the first forming element 12 and the second forming element 13 be formed in any one of a circular shape, an oval shape and a polygonal shape close to a circular shape or an oval shape.

As stated earlier, the combination of the first forming element 12 and the second forming element 13 in the radiating conductor 11 according to the present invention is not limited to the combination of a circular shape and a semi-oval shape as shown in FIG. 1. The first forming element 12 may be formed in a shape selected among a polygonal, a substantial polygonal, a circle, a substantial circle, an oval, and a substantial oval, and the second forming element 13 may have at least one portion formed in a shape selected among a polygonal, a substantial polygonal, a circle, a substantial circle, an oval, a substantial oval, a trapezoid and a substantial trapezoid.

EXAMPLE 7

COMPARATIVE EXAMPLE

Example 7 is an antenna device, which employs an antenna body 110 (see FIG. 33) comprising a circular radiating conductor 111 instead of the antenna body 10 shown in FIG. 1, and which is not included in the antenna device according to the present invention. In FIG. 33, reference numeral 114 designates a feeder, reference numerals 115*a* and 115*b* designate ground patterns, and reference numeral 116 designates a dielectric member. The feeder 114, the ground patterns 115*a* and 115*b*, and the dielectric member 116 have the same structures as the feeder 14, the ground patterns 15*a* and 15*b*, and the dielectric member 16 shown in FIG. 1.

The antenna 110 shown in FIG. 33 is configured so that the radiating conductor 111 is disposed in parallel with an insulating substrate 17 as shown in FIG. 3 without a planar disc monopole 101, as the radiating conductor shown in FIG. 31, being upright vertically from a metal plate 103.

The dimensions of main parts of the antenna device in Example 7 shown in FIG. 33 are shown in Table 1.

The fractional bandwidth in Example 7 shown in FIG. 5 is 40%.

EXAMPLE 8

EXAMPLE

Figure 15:
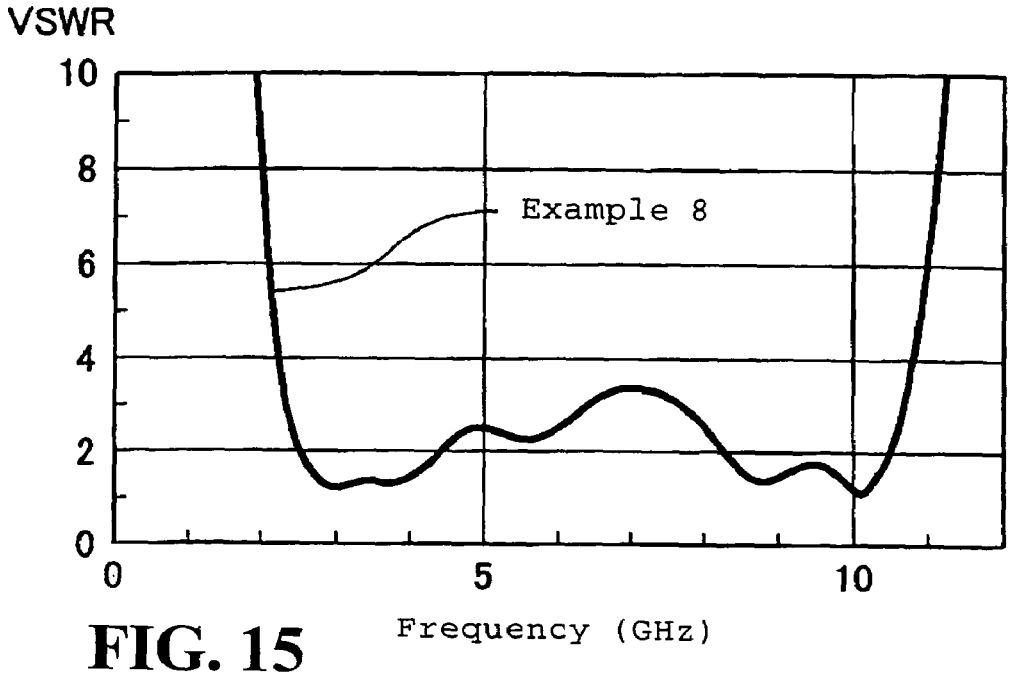
FIG. 15 is a graph showing a frequency characteristic of VSWR in Example 8, wherein the ground patterns are eliminated from Example 1 shown in FIG. 1.

In the antenna device 1 according to the present invention, it is not always necessary to dispose the ground patterns 15*a* and 15*b*. FIG. 15 is a graph showing a frequency characteristic of VSWR in Example 8, wherein the ground patterns 15*a* and 15*b* are eliminated from Example 1. The frequency characteristic are found in accordance with electromagnetic field simulation by the FI method. The dimensions of main parts of the antenna device 1 in Example 8 are shown in Table 2 below along with the dimensions of major parts of Examples 9 to 18 stated later. The words "length" and "width" in items of "ground pattern", "dielectric member", "insulating substrate" and "ground conductor" in Table 2 mean the length in the vertical direction and the length in the transverse direction in each of FIG. 2 and FIG. 6.

TABLE 2

| | Ex. 8 | Exs. 9 to 11 | Ex. 12 | Ex. 13 |
|---|---|---|---|---|
| Structural view showing antenna body | FIG. 1 | FIG. 1 | FIG. 1 | FIG. 1 |
| First forming element | Circular shape Diameter: 6 mm | Circular shape Diameter: 8 mm | Circular shape Diameter: 8 mm | Circular shape Diameter: 8 mm |
| Second forming element | Semi-oval shape (Major axis radius: 6 mm Minor axis radius: 1 mm) | Semi-oval shape (Major axis radius: 6 mm Minor axis radius: 1 mm) | Semi-oval shape (Major axis radius: 6 mm Minor axis radius: 1 mm) | Semi-oval shape (Major axis radius: 6 mm Minor axis radius: 1 mm) |
| Ground pattern (length × width) | — | 1 mm × 0.7 mm | 1 mm × 0.7 mm | 1 mm × 0.7 mm |
| Dielectric member (length × width) | 15 mm × 13 mm | 12 mm × 12 mm | 12 mm × 12 mm | 12 mm × 12 mm |
| Insulating substrate (length × width) | 45 mm × 30 mm | 32 mm × 20 mm | 62 mm × 50 mm | 62 mm × 50 mm |
| Ground conductor (length × width) | 30 mm × 30 mm | 20 mm × 20 mm | 50 mm × 50 mm | 50 mm × 50 mm |

| | Exs. 14 and 15 | Ex. 16 | Ex. 17 | Ex. 18 |
|---|---|---|---|---|
| Structural views showing antenna body | FIG. 1 | FIG. 1, FIG. 10, FIG. 11 | FIG. 10 | FIG. 1 |
| First forming element | Circular shape Diameter: 8 mm | Length in transverse direction: 8.6 mm Modify vertical length ratio α | Oval shape (Major axis radius: 4.3 mm Minor axis radius: 2.6 mm) | Square shape One side: 8 mm |
| Second forming element | Semi-oval shape (Major axis radius: 6 mm Minor axis radius: 1 mm) | Semi-oval shape (Major axis radius: 6 mm Minor axis radius: 0.6 mm) | Semi-oval shape (Major axis radius: 6 mm Minor axis radius: 0.4 mm) | Square shape Side: 2 mm |
| Ground pattern (length × width) | 1 mm × 0.7 mm | 1 mm × 2.5 mm | 1 mm × 2.5 mm | 1 mm × 0.7 mm |
| Dielectric member (length × width) | 12 mm × 12 mm | 10 mm × 10 mm | 10 mm × 10 mm | 12 mm × 12 mm |
| Insulating substrate (length × width) | 62 mm × 50 mm | 28 mm × 30 mm | 28 mm × 30 mm | 32 mm × 20 mm |
| Ground conductor (length × width) | 50 mm × 50 mm | 17 mm × 30 mm | 17 mm × 30 mm | 20 mm × 20 mm |

As shown in FIG. 15, the fractional bandwidth in Example 8 is 57%, which means that the fractional bandwidth has improved in comparison with Example 1. On the other hand, the value of VSWR in Example 8 is away from 1 in comparison with Example 1. This reveals that the ground patterns 15*a* and 15*b* have no effect on the width of an operating frequency band, and that the ground patterns cooperate with the feeder 14 to effectively provide impedance matching. Since VSWR gets away from 1 by eliminating the ground patterns 15*a* and 15*b* as stated earlier, it is preferred that the ground patterns 15*a* and 15*b* be disposed to effectively provide impedance matching. Additionally, it is further preferred that the insulating substrate 17 be provided with auxiliary patterns and vias (not shown), and that the ground patterns 15*a* and 15*b* be connected to the ground conductor 18 through the auxiliary patterns and the vias.

EXAMPLES 9, 10, 11

EXAMPLES

Figure 17:
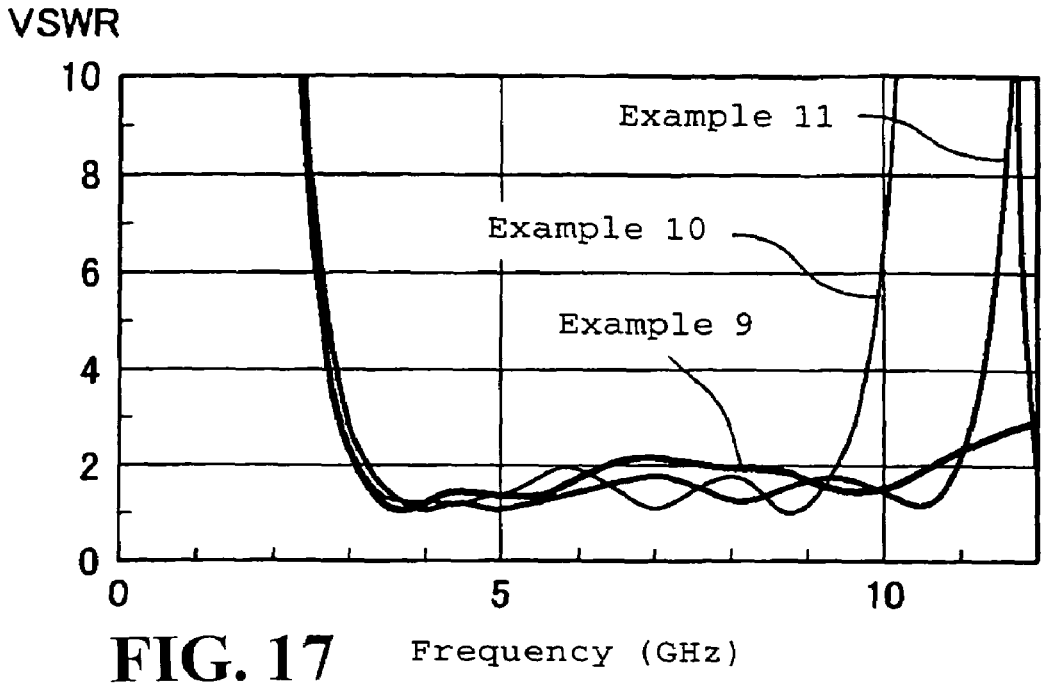
FIG. 17 is a graph showing frequency characteristics of VSWR in Examples 9 to 11 of the antenna device according to the present invention.

FIG. 16 is a view showing an antenna body 10, which has a radiating conductor 11 disposed in a pair of two kinds of dielectric layers having different relative dielectric constants. FIG. 17 is a graph showing frequency characteristics of VSWR when the relative dielectric constants of the dielectric member 16 were modified. The frequency characteristics are found in accordance with electromagnetic field simulation by the FI method. In Example 9, the radiating conductor 11 was disposed in a laminated member comprising dielectric layers having a single relative dielectric constant of 6.6. In Example 10, the radiating conductor 11 was disposed in a laminated member comprising dielectric layers having a single relative dielectric constant of 22.7. In Example 11, the radiating conductor 11 was disposed in two sets of dual dielectric layers having different relative dielectric constants as shown in FIG. 16. In each pair, a first dielectric layer 32 has a relative dielectric constant of 22.7, and a second dielectric layer 33 has a relative dielectric constant of 6.6.

The dimensions of main parts of the antenna device 1 in each of Examples 9 to 11 are shown in Table 2. As shown in FIG. 17, it is revealed that the fractional bandwidth in each of Examples 9 to 11 is wider than the fractional bandwidth in Example 7 shown in FIG. 5.

EXAMPLE 12

EXAMPLE

The portion where the antenna body 10 is mounted to the insulating substrate 17 is the opposite region of the exposed portion 24 where the insulating substrate 17 is exposed without the ground conductor 18 being disposed as shown in FIG. 2. In this case, the shape and the dimensions of the ground conductor 18 have no significant adverse effect on a frequency characteristic having a wide operating frequency band.

Figure 18:
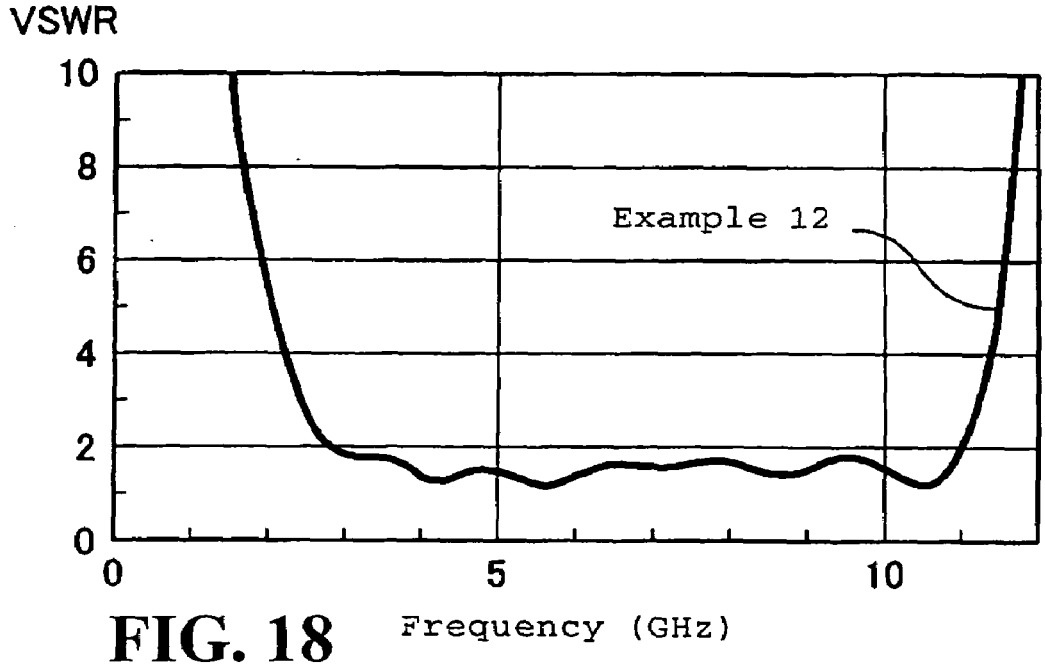
FIG. 18 is a graph showing a frequency characteristic of VSWR in Example 12 of the antenna device according to the present invention.

FIG. 18 is a graph showing a frequency characteristic of VSWR of Example 12, wherein the dimensions of the ground conductor 18 are different from the one in Example 11. The frequency characteristic is found in accordance with electromagnetic field simulation by the FI method. The dimensions of main parts of the antenna device 1 in Example 12 are shown in Table 2.

As seen from FIG. 18, when the size of the ground conductor 18 is increased, the fractional bandwidth is improved. This means that it is possible to prevent a frequency characteristic having a wide operating frequency band from being degraded as long as the ground conductor 18 is disposed so as to have at least a size substantially equal to the size in Example 11.

EXAMPLE 13

EXAMPLE

Although the antenna body 10 shown in FIG. 2 is configured to be disposed on a region without the ground conductor 18 disposed thereon, i.e., the opposite region opposite the exposed portion 24 of the insulating substrate 17, the position where the antenna body 10 is disposed has no adverse effect on frequency characteristics having a wide operating frequency band.

Figure 19:
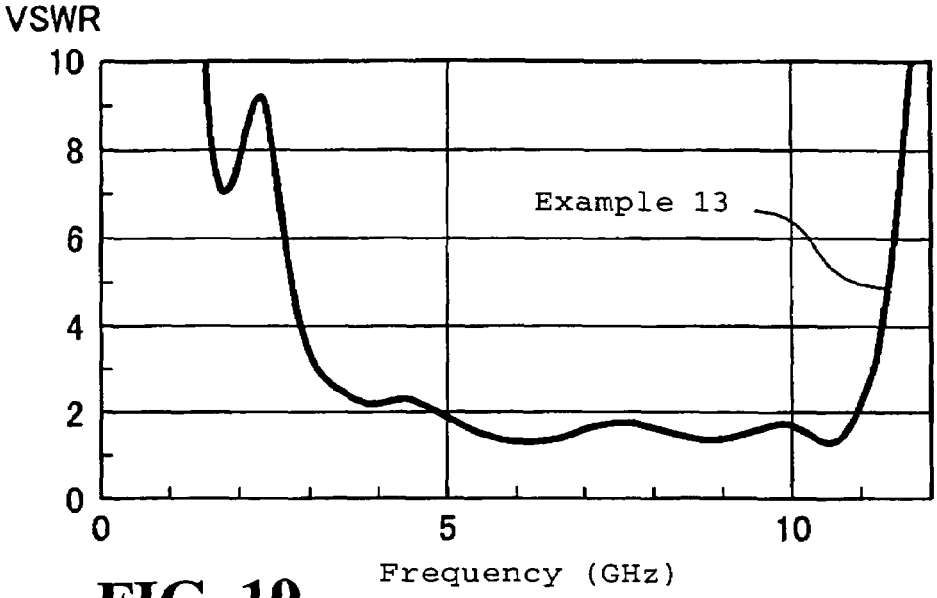
FIG. 19 is a graph showing a frequency characteristic of VSWR in Example 13 of the antenna device according to the present invention.

FIG. 19 is a graph showing a frequency characteristic of VSWR of Example 13, wherein the antenna body 10 shown in FIG. 1 was disposed on a central portion of the exposed portion 24 of the insulating substrate 17. The frequency characteristic is found in accordance with electromagnetic field simulation by the FI method.

The dimensions of main parts of the antenna device 1 of Example 13 are shown in Table 2. In Example 12, the antenna element 10 is disposed on a right end portion of the opposite region opposite the exposed portion of the insulating substrate 17. Even Example 13 exhibits a good characteristic as in Example 12. However, the fractional bandwidth is slightly decreased in comparison with Example 12. From this viewpoint, it is preferred that the antenna body 10 be disposed on an end portion of the opposite region opposite the exposed portion of the insulating substrate 17. It is more preferred that the antenna body be disposed at one of the four corners of the insulating substrate 17. Although the antenna body 10 is disposed at an upper right end in FIG. 2, the antenna body may be disposed at an upper left end, a lower right end on a lower left end.

EXAMPLES 14 and 15

EXAMPLES

Figure 20:
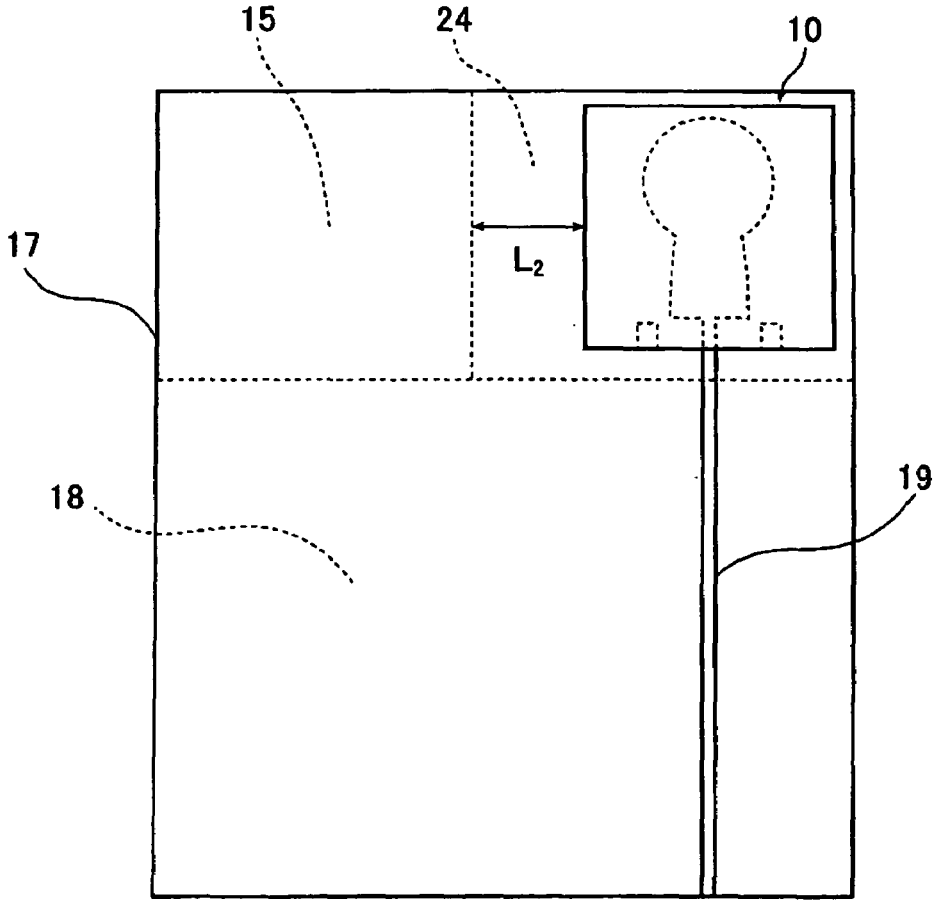
FIG. 20 is a view showing another embodiment of the antenna device according to the present invention.

Although in the present invention, the antenna body 10 is disposed on the opposite region opposite the exposed portion of the insulating substrate 17, a second ground conductor 15 may be disposed so as to have an end portion located at a position away from an end of the antenna body 10 (an end of the dielectric member 16) by a distance $L_2$ as shown in FIG. 20. The distance $L_2$ is a distance in a direction perpendicular to the extending direction of the signal line.

Figure 21:
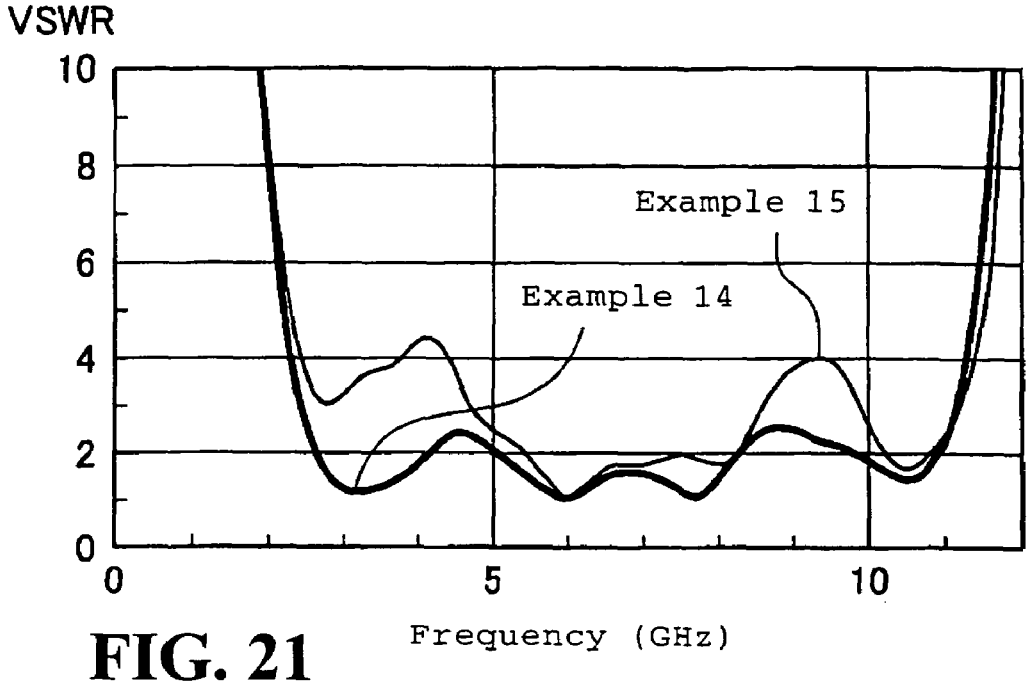
FIG. 21 is a graph showing frequency characteristics of VSWR in Examples 14 and 15 of the antenna device according to the present invention.

FIG. 21 is a graph showing frequency characteristics of VSWR in Example 14, wherein the distance $L_2$ in FIG. 20 is 3 mm, and in Example 15, wherein the distance $L_2$ is 0 mm. The frequency characteristics are found in accordance with electromagnetic field simulation by the FI method. The dimensions of main parts in the antenna device 1 in each of Examples 14 and 15 are shown in Table 2.

Example 14 has a fractional bandwidth of 50%, providing a wide fractional bandwidth and an operating frequency band in a wide band. Example 15 has a fractional bandwidth decreasing to about 42%, almost half. From this viewpoint, it is preferred that the second ground conductor 15 be disposed so as to have a distance $L_2$ of 3 mm or longer in the antenna device with the antenna body 10 mounted thereto.

The insulating substrate 17 with the ground conductor 10 disposed thereon may comprise a circuit board with another circuit element disposed thereon. In this case, the ground conductor of the circuit board serves as the ground conductor 18. The antenna body 10 is disposed on an opposite region opposite an exposed portion of the circuit board, i.e. a region of an opposite surface opposite the exposed portion 24 of the insulating substrate 17. This means that the region of the circuit board except for the exposed portion can be utilized as a space for disposing another circuit element or the like. When the second ground conductor 15 is disposed, it is possible to increase the space for disposing such a circuit element or the like.

By disposing the second ground conductor 15 as stated earlier, the exposed portion 24 can be made smaller, providing an antenna device having a small structure and a wide operating frequency band.

EXAMPLES 16 and 17

EXAMPLES

Now, a relationship between the shape and the fractional bandwidth of the radiating conductor 11 shown in FIG. 4 will be explained.

As an index representing the shape of the radiating conductor 11, a longitudinal length ratio is determined according to the following formula (1) using the vertical length $L_{31}$ of the first forming element 12 and the vertical length $L_{32}$ of the projected portion of the second forming element 13 projecting from the first forming element 12 in the radiating conductor 11 as shown in FIG. 4. $L_{31}+L_{32}$ is the entire vertical length of the outline of the pattern shape of the radiating conductor 11.

$$\text{Vertical length ratio } \alpha = L_{31}/(L_{31}+L_{32}) \quad (1)$$

Although a portion having the smallest radius of curvature in the semi-oval shape of the second forming element 13 is located in the vicinity of substantially the center of the circular shape of the first forming element 12 in the radiating conductor 11 shown in FIG. 4, that portion does not always be restricted to be located in the vicinity of the center. By removing such restriction to adjust the vertical length ratio α, it is possible to obtain an antenna device having a wide fractional bandwidth and an operating frequency band in a wide band.

The antenna device 1 of Example 16 has a structure similar to Examples 1 and 2, and the dimensions of main parts are shown in Table 2.

The radiating conductor 11 is disposed in two sets of dual electric layers having different related dielectric constants, as shown in FIG. 16. In each set, a first dielectric layer 32 has a relative dielectric constant of 18.5 and a thickness of 0.25 mm, and a second dielectric layer 33 has a relative dielectric constant of 7.2 and a thickness of 0.25 mm. The entire thickness of the dielectric member 16 is 1.0 mm.

The feeder 14, which is connected to a peripheral portion of the second forming element 13 remote from the first forming element 12, has a length of 0.9 mm and a width of 0.2 mm. The other peripheral portion of the feeder 14, which is not connected to the second forming element 13, is located at a position away from an end of the dielectric member 16 (the lower end of the dielectric member 16 in FIG. 1) by a distance of 0.7 mm.

Additionally, the ground patterns 15*a* and 15*b* are disposed on a surface of the dielectric member 16 in contact with the insulating substrate 17, and an unshown feeding pad is disposed between the ground patterns 15*a* and 15*b*. The unshown feeding pad has dimensions of 1.1 mm in length and 1.4 mm in width. The distance between the feeding pad and each of the ground patterns 15*a* and 15*b* is 0.5 mm. The feeding pad is connected to an end of the feeder 14 through the via 20.

The insulating substrate 17 has a thickness of 0.8 mm and a relative dielectric constant of 4.7. The insulating substrate 17 has the signal line 19 disposed on one of the surfaces thereof and the ground conductor 18 disposed on the other surface. As shown in FIG. 2, the dielectric member 16 is disposed at an upper right portion on the surface with the signal line 19 disposed thereon. The signal line 19 is a signal line of a micro-strip transmission line and has a width of 1.4 mm. The signal line 19 is connected to the feeding pad of the dielectric member 16, and the ground patterns 15*a* and 15*b* are connected to the ground conductor 18 through the feeding pads and vias, which are disposed in the insulating substrate 17 and is not shown.

The first forming element 12 and the second forming element 13 of the radiating conductor 11, and the feeder 14 are disposed on the same plane in the dielectric member 16 (at a substantially central portion in the thickness direction). The linear portion in the semi-oval shape (a portion obtained by cutting the oval shape in half) in the second forming element 13 is disposed so as to project from the first forming element 12. The length of the first forming element 12 in the transverse direction is 8.6 mm, the entire length of $L_{31}+L_{32}$ of the radiating conductor 11 in the vertical direction is 8.2 mm, and the longitudinal length ratio α is modified by changing the length $L_{31}$. Thus, the first forming element 12 is modified into an oval shape or a circular shape according to a longitudinal length ratio α.

Figure 22:
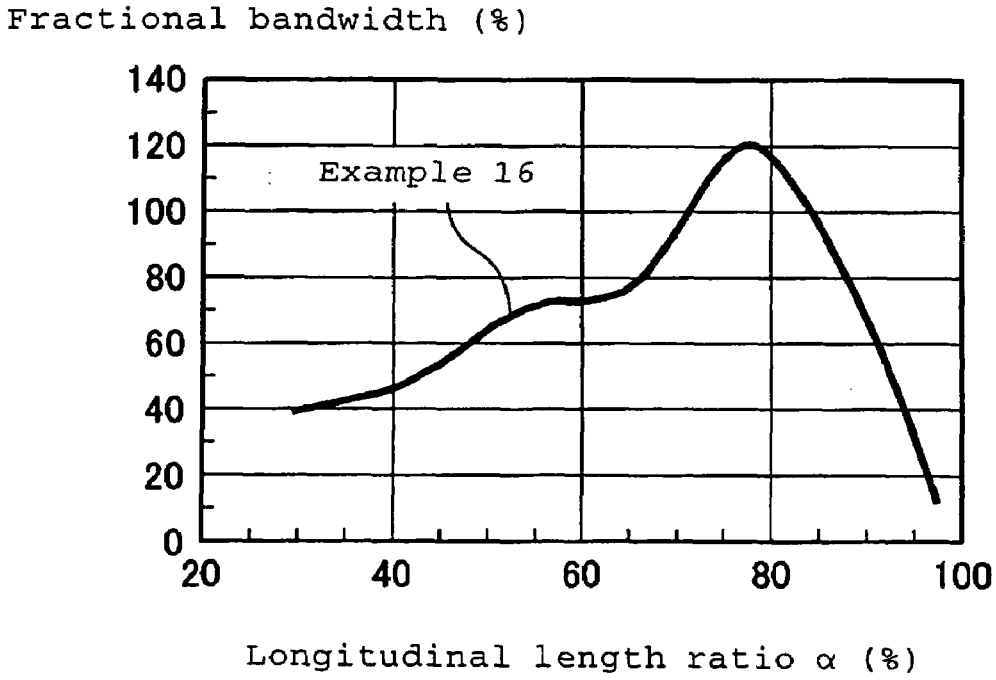
FIG. 22 is a characteristic diagram representing a relationship between a longitudinal length ratio $\alpha$ and a fractional bandwidth in Example 16 of the antenna device according to the present invention.

FIG. 22 is a characteristic diagram showing a relationship between a longitudinal length ratio α and a fractional bandwidth of the antenna device 1 of Example 16. The characteristic diagram is found, using a frequency characteristics of VSWR found in accordance with electromagnetic field simulation by the FI method.

According to FIG. 22, it is possible to obtain a fractional bandwidth of 40% or more over a wide band for longitudinal length ratios α from 30 to 95%. The longitudinal length ratio α preferably ranges from 42 to 93% (having a fractional bandwidth of 50% or more), and the longitudinal length ratio α more preferably ranges from 50 to 92% (having a fractional bandwidth of 60% or more). It is preferred that the shape of the radiating conductor 11 be determined as stated earlier.

Figure 23:
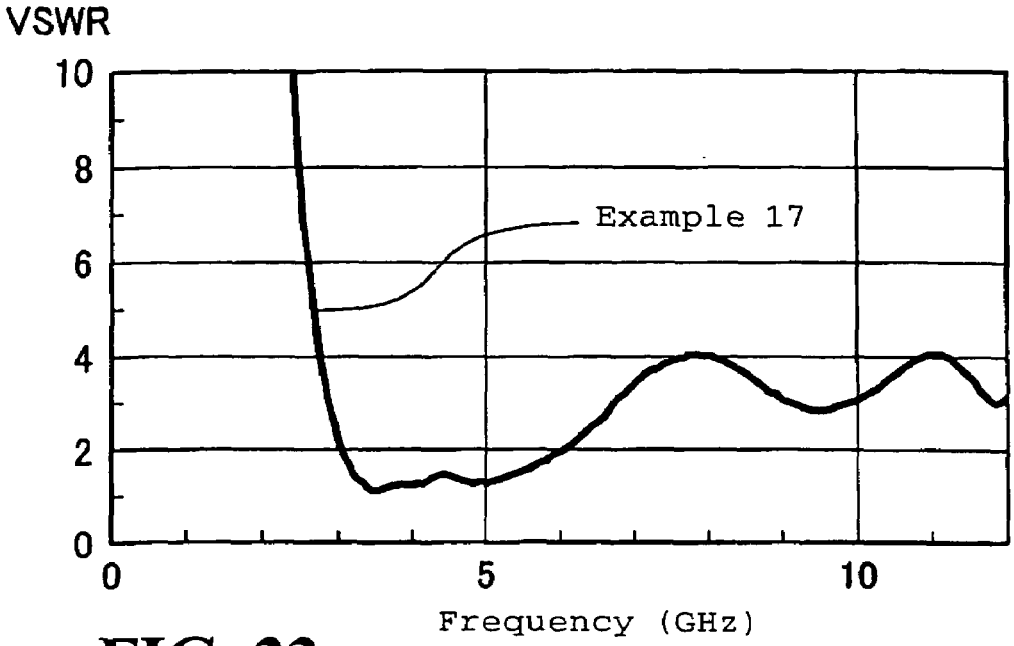
FIG. 23 is a graph showing a frequency characteristic of VSWR in Example 16 of the antenna device according to the present invention.

Additionally, an antenna device 1 which included a radiating conductor 11 wherein the longitudinal length ratio α was 64%, was fabricated as Example 17, and VSWR was measured. FIG. 23 is a graph showing measurement result of a frequency characteristic of VSWR.

The antenna device 1 of Example 17 was fabricated, using a fabricating method similar to Example 3.

The dimensions of main parts of the antenna device 1 of Example 17 are shown in Table 2.

In this case, the entire length of $L_{31}+L_{32}$ in the vertical direction, which is represented as the pattern shape of the radiating conductor 11, is 8.1 mm. The antenna device had the same structure as Example 16 except for the shape of the radiating conductor 11.

The fractional bandwidth of Example 17 shown in FIG. 23 is 69%.

Even when the second forming element 13 was formed in a rectangular shape, when the length $L_{32}$ was 2.9 mm and when the length in the transverse direction was 0.8 mm, it was verified that a similar fractional bandwidth was able to be obtained.

EXAMPLE 18

EXAMPLE

An antenna device wherein the shape of the radiating conductor 11 is modified will be explained as Example 18.

Figure 24:
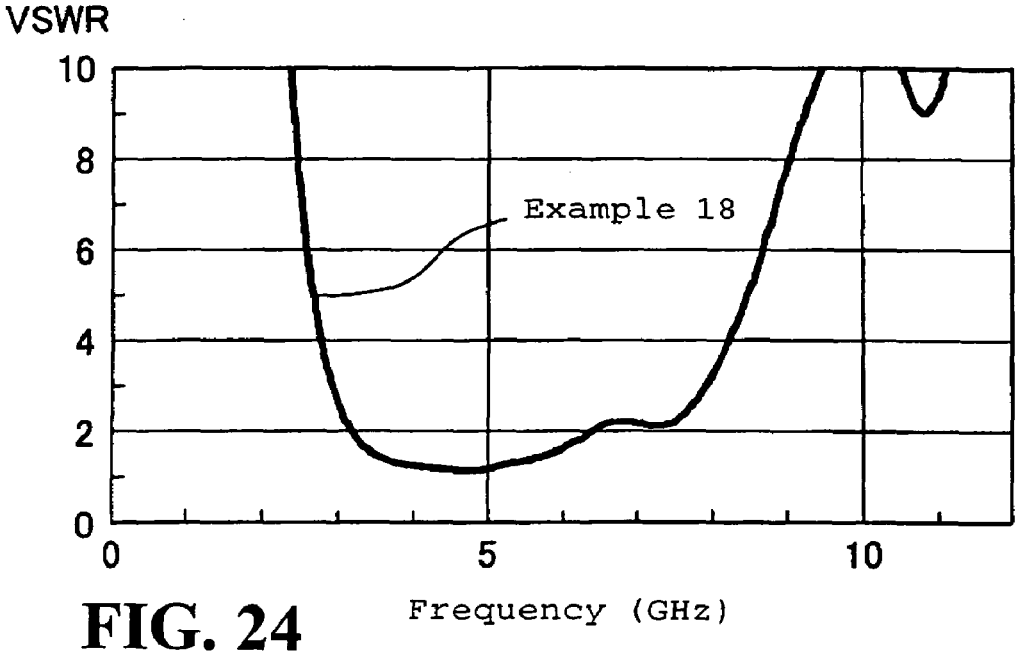
FIG. 24 is a graph showing a frequency characteristic of VSWR in Example 18 of the antenna device according to the present invention.

FIG. 24 is a graph showing a frequency characteristic of VSWR of Example 18. The frequency characteristic is found in accordance with electromagnetic field simulation by the FI method.

The dimensions of main parts of the antenna device of Example 18 are shown in Table 2. The phrase "square shape one side: 2 mm" of the second forming element 13 of Example 18 means that the shape of the second forming element projecting from the first forming element 12 has a square shape having sides of 2 mm.

The feeder 14 has a length of 0.7 mm and a width of 0.2 mm. The distance between the right edge of the feeder 14 and the left edge of the ground pattern 15*a*, and the distance between the left edge of the feeder 14 and the right edge of the ground pattern 15*b* are 2 mm. The antenna body 10 is mounted to an upper surface of the insulating substrate 17*b* as shown in FIG. 2. The ground conductor 18 is disposed on a side opposite the side with the antenna body 10 mounted thereto.

The fractional bandwidth of Example 18 shown in FIG. 24 is 68%.

Now, an antenna device 2 wherein, as shown in FIGS. 6 and 7, the reflector 41 and the dielectric layer 51 are added to the structure of the antenna device 1 including the antenna body 10 and the insulating substrate 17, will be explained.

EXAMPLE 19

EXAMPLE

The radiating conductor 11 of the antenna body 10, which is employed in the antenna device 2 in Example 19, is disposed in a dielectric member 16, which comprises two sets of dielectric layers having different relative dielectric constants, as shown in FIG. 16. The antenna device 2 is one with the reflector 41 added thereto as in the structure of Example 16.

The dimensions of main parts of the antenna device 2 of Example 19, as well as dimensions of Examples 20 and 21 stated below, are shown in Table 3 below. The words "length" and "width" in items of "ground pattern", "dielectric member", "insulating substrate" and "ground conductor" in Table 3 mean the length in the vertical direction and the length in the transverse direction in FIG. 2 and FIG. 6.

TABLE 3

| | Ex. 19 | Ex. 20 | Ex. 21 |
|---|---|---|---|
| Structural view showing antenna body | FIG. 10 | FIG. 10 | FIG. 10 |
| First forming element | Oval shape<br>Major axis radius: 4.3 mm<br>Minor axis radius: 3.2 mm | Oval shape<br>Major axis radius: 4.3 mm<br>Minor axis radius: 2.6 mm | Oval shape<br>Major axis radius: 4.3 mm<br>Minor axis radius: 3.2 mm |
| Second forming element | Semi-oval shape<br>Major axis radius: 6 mm<br>Minor axis radius: 0.6 mm | Semi-oval shape<br>Major axis radius: 6 mm<br>Minor axis radius: 0.4 mm | Semi-oval shape<br>Major axis radius: 6 mm<br>Minor axis radius: 0.6 mm |
| Ground pattern (length × width) | 1 mm × 2.5 mm | 1 mm × 2.5 mm | 1 mm × 2.5 mm |
| Dielectric member (length × width) | 10 mm × 10 mm | 10 mm × 10 mm | 10 mm × 10 mm |
| Insulating substrate (length × width) | 28 mm × 30 mm | 28 mm × 30 mm | 28 mm × 30 mm |
| Ground conductor (length × width) | 17 mm × 30 mm | 17 mm × 30 mm | 17 mm × 30 mm |
| Reflector ($L_{41} \times L_{42}$) | 60 mm × 60 mm | 60 mm × 60 mm | 40 mm × 40 mm |
| Dielectric layer ($L_{51} \times L_{52}$) | — | — | 30 mm × 28 mm |

The length $L_{32}$ of a portion of the second forming element 13 in the vertical direction, which projects from the first forming element 12 of the radiating conductor 11, is 1.8 mm. The insulating substrate 17 is disposed in the vicinity of substantially the center of the reflector 41, and the insulating substrate 17 and the reflector 41 are configured to be substantially parallel with each other. The reflector 41 is disposed away from the insulating substrate by a desired distance (distance $L_{43}$)

Figure 25:
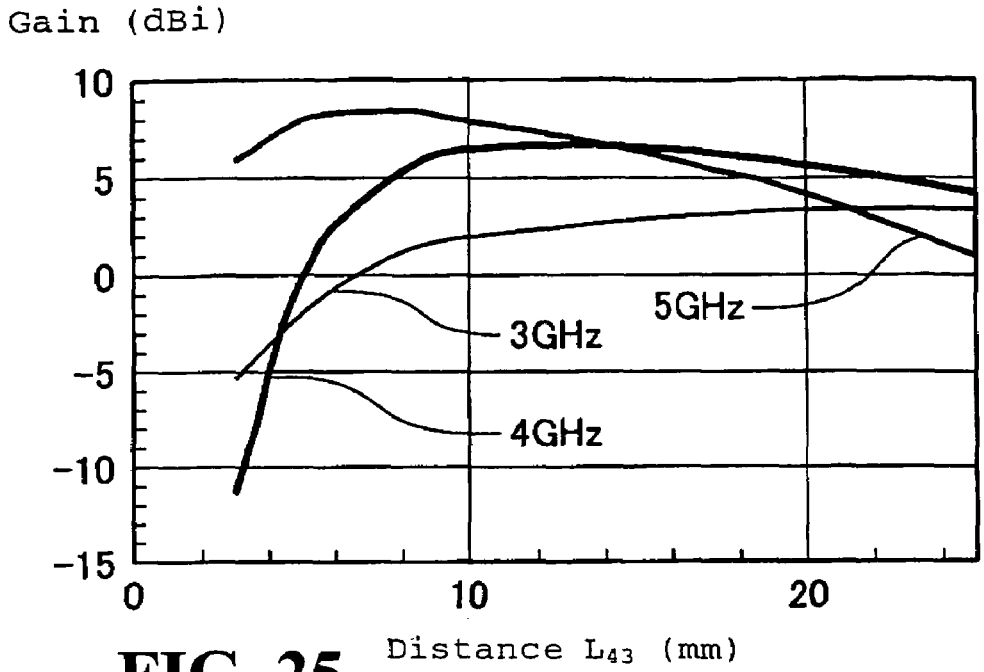
FIG. 25 is a characteristic diagram showing antenna device gain characteristics when the distance $L_{43}$ of the antenna device in Example 19 of the antenna device according to the present invention was modified.

FIG. 25 is a characteristic diagram showing gain characteristics in the Z axis direction (θ=0 deg) in FIGS. 6 and 7 when the distance $L_{43}$ of the antenna device 2 is modified. The characteristics are found in accordance with electromagnetic field simulation by the FI method.

As shown in FIG. 25, the reflector 41 performs a required function in a wide band of frequency range by adjusting the distance $L_{43}$, and the antenna device 2 exhibits high gain characteristics over a wide band. The distance $L_{43}$ preferably ranges from 5 to 25 mm. In this range, the antenna device has high gain characteristics in a wide band of frequency range from 3 to 5 GHz. The distance $L_{43}$ more preferably ranges from 7 to 22 mm.

Figure 26:
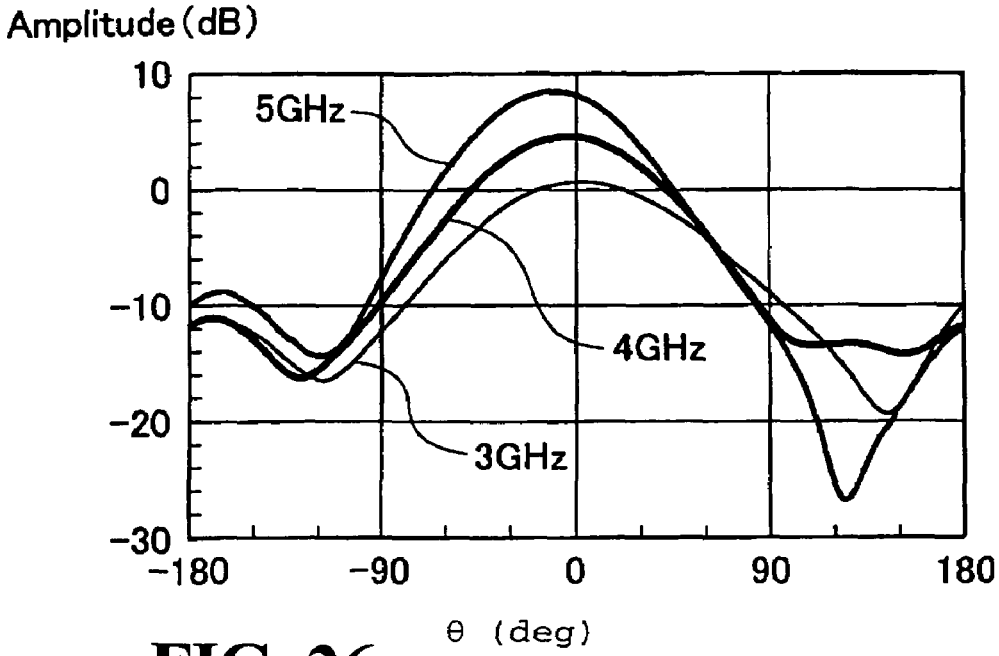
FIG. 26 is a characteristic diagram showing a radiation pattern of vertical polarization when the distance $L_{43}$ in Example 19 of the antenna device according to the present invention was 7.5 mm.

FIG. 26 is a characteristic diagram showing a radiation pattern of vertical polarization on the X-Z plane shown in FIGS. 6 and 7 when the distance $L_{43}$ was 7.5 mm. This radiation pattern is found in accordance with electromagnetic field simulation by the FI method. As shown in FIG. 26, the antenna device 2 of Example 19 exhibits high gain characteristics over a wide band (frequency band) in the vicinity of θ=0 deg.

On the other hand, FIG. 27 is a characteristic diagram showing gain characteristics in the Z axis direction (0=0 deg) in FIGS. 6 and 7 when the distance $L_{43}$ is 10 mm, and when the length $L_{41}$ in the vertical direction (the vertical direction in FIGS. 6 and 7) is modified. The characteristics were found in accordance with electromagnetic field simulation by the FI method. The length $L_{42}$ is the same as the length $L_{41}$.

As shown in FIG. 27, the reflector 41 performs a required function in a wide band of operating range by adjusting the length $L_{41}$ and the length $L_{42}$, and the antenna device 2 exhibits high gain characteristics over a wide band. The preferred range of the length $L_{41}$ and/or the length $L_{42}$ is 30 mm or more. Since the size of the insulating substrate 17 is 28 mm in length and 30 mm in width, it is preferred that the length $L_{41}$ and/or the length $L_{42}$ of the reflector 41 be at least equal to the lengths of the insulating substrate 17 in the corresponding directions. For example, even if the length $L_{41}$ of the reflector 41 is shorter than the length of the insulating substrate 17 in the transverse direction, it is sufficient that the length $L_{42}$ is longer than the length of the insulating substrate 17 in the vertical direction. It is more preferred that the length $L_{41}$ and/or the length $L_{42}$ of the reflector be 40 mm or more. In other words, it is sufficient that each of the length $L_{41}$ and/or the length $L_{42}$ of the reflector 41 be at least 1.3 times the length the corresponding vertical direction and/or the length in the corresponding transverse direction of the insulating substrate 17.

By adjusting the length $L_{41}$, the length $L_{42}$ and the distance $L_{43}$ of the reflector 41, it is possible to effectively operate the metal plate as the reflector.

EXAMPLE 20

EXAMPLE

Now, an antenna device 2, wherein only the shapes of the first forming element 12 and the second forming element 13 of the radiating conductor 11 in the antenna device 2 of Example 19 were modified, will be explained as Example 20.

The dimensions of main parts of the antenna device 2 of Example 20 are shown in Table 3.

The entire length $L_{31}+L_{32}$ in the vertical direction, which appears as the outline of the pattern shape of the radiating conductor 11, is 8.1 mm, and the length $L_{32}$ is 2.9 mm.

FIG. 28 is a characteristic diagram showing a radiation pattern of vertical polarization on the X-Z plane shown in FIGS. 6 and 7 when the distance $L_{43}$ is 10 mm. This radiation pattern is also found in accordance with electromagnetic field simulation by the FI method.

As shown in FIG. 28, the antenna device 2 of Example 20 exhibits high gain characteristics over a wide band (frequency band) in the vicinity of θ=0 deg.

Even when the second forming element 13 is formed in a rectangular shape, when the length $L_{32}$ is 2.9 mm and when the length in the transverse direction is 0.8 mm, it was verified that the antenna device has a radiation pattern similar to FIG. 28.

EXAMPLE 21

EXAMPLE

Additionally, a characteristic of the dielectric layer 51 in the antenna device 2 shown in FIGS. 6 and 7 will be explained.

The antenna device 2 is configured so that in an assembly comprising an antenna body 10 and an insulating substrate 17 formed in the same structure and the same dimensions as Example 19, the reflector 41 having a flat metal surface is disposed in the vicinity of substantially the center of the insulating substrate 17, and the reflector 41 and the insulating substrate 17 are disposed substantially in parallel with each other.

The dimensions of main parts of the antenna device 2 in Example 21 are shown in Table 3.

The insulating substrate 17, the air layer 61, the dielectric layer 51 and the reflector 41 are provided in this order, and the air layer 61 and the dielectric layer 51 are substantially in parallel with the reflector 41.

In the antenna device 2 thus configured, the dielectric layer 51 performs a required function in a wide band of frequency range by setting the thickness $L_{53}$ of the dielectric layer 51 in a certain range, and the antenna device 2 exhibits high gain characteristics over a wide band.

Figure 29:
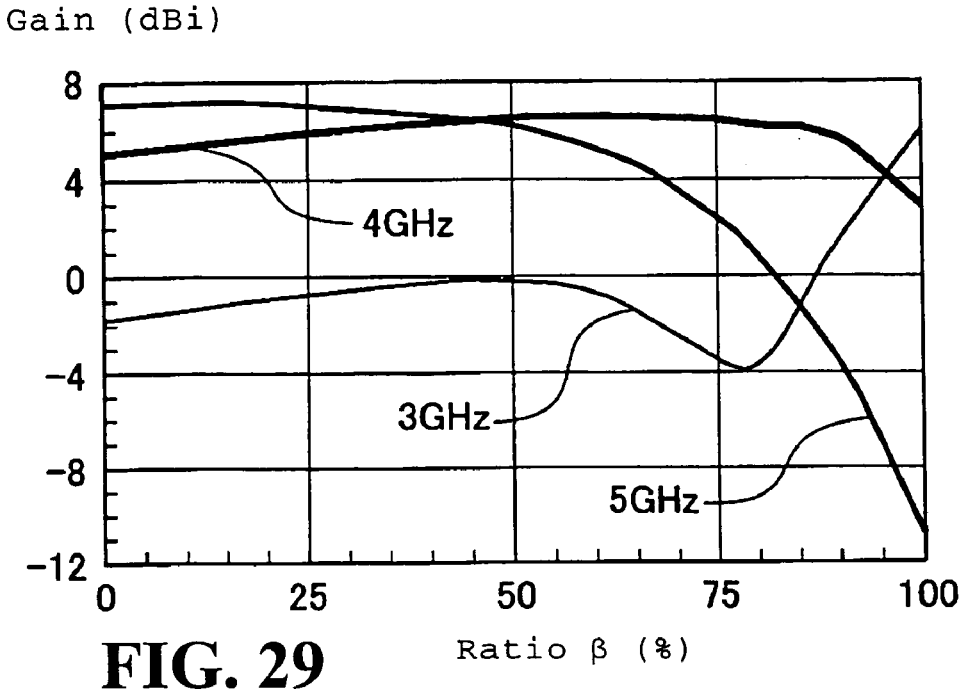
FIG. 29 is a characteristic diagram showing antenna device gain characteristics in Example 21 of the antenna device according to the present invention.

FIG. 29 shows a characteristic diagram showing gain characteristics in the Z axial direction (θ=0 deg) in FIGS. 6 and 7 when the ratio β of the thickness $L_{53}$ to the distance $L_{43}$ is modified. The characteristics are found in accordance with electromagnetic field simulation by the FI method.

The ratio β is represented by the following formula (2).

$$\text{Ratio } \beta = L_{53}/L_{43} \times 100 \quad (2)$$

As shown in FIG. 29, by adjusting the ratio β, i.e., the thickness $L_{53}$ of the dielectric layer 51, the dielectric layer 51 performs a required function in a wide band of frequency range, and the antenna device 2 exhibits high gain characteristics over such a wide band. The ratio β preferably ranges from 5 to 80%. In this range, it is possible to obtain high gain characteristics in a wide band of frequency range from 3 to 5 GHz. The ratio β more preferably ranges from 10 to 70%. In this range, it is possible to obtain high gain characteristics in a wide band of frequency range from 3 to 4 GHz. The ratio β particularly preferably ranges from 10 to 60%.

As shown in FIG. 29, when the ratio β is equal to 40% (the thickness $L_{53}$ of the dielectric layer 51 is 4 mm), the gain is improved by 2 dBi at 3 GHz and by 1.2 dBi at 4 GHz, being compared to when only the reflector 41 is disposed without the dielectric layer 51 (ratio β=0).

Figure 30:
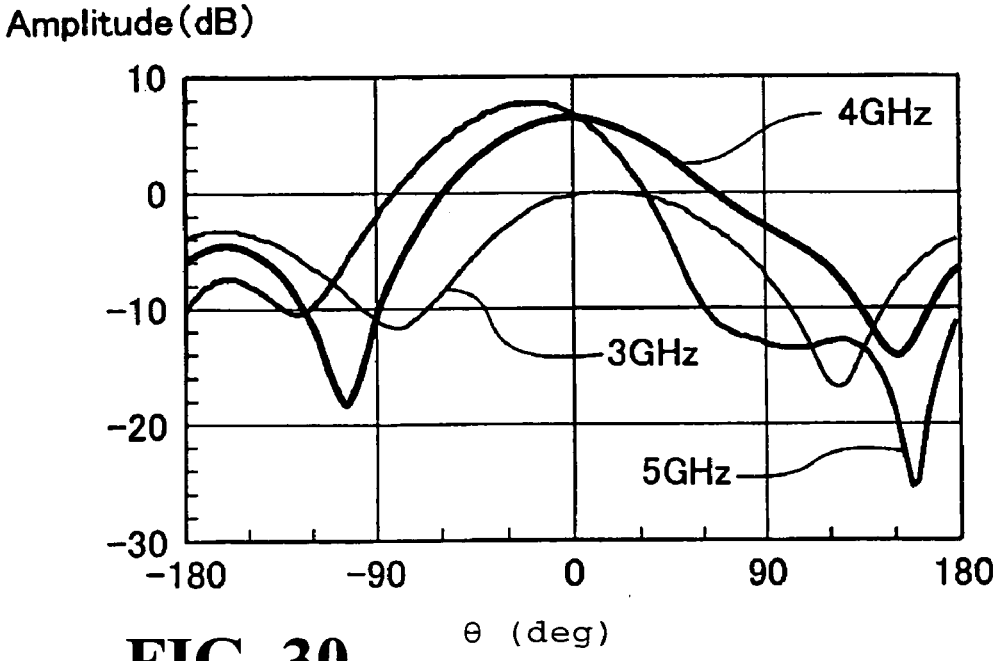
FIG. 30 is a characteristic diagram showing of a radiation pattern of vertical polarization, when the ratio $\beta$ is 40% in Example 21 of the antenna device according to the present invention.

FIG. 30 is a characteristic diagram showing a radiation pattern of vertical polarization on the X-Z plane shown in FIGS. 6 and 7 when the ratio β is 40%. This radiation pattern is also found in accordance with electromagnetic field simulation by the FI method. As shown in FIG. 30, the antenna device 2 of Example 21 exhibits high gain characteristics over a wide band in the vicinity of θ=0 deg.

Even when the second forming element 13 is formed in a rectangular shape, when the length $L_{32}$ is 2.9 mm and when the length in the transverse direction is 0.8 mm, it is verified to obtain a radiation pattern similar to FIGS. 29 and 30.

Although explanation of the monopole antenna, wherein the radiating conductor 11 is connected to an unbalanced line, such as a micro-strip line, has been made, the present invention is not limited to the monopole antenna, and two pairs of radiating conductors 11 and antenna bodies 10 may be disposed to employ the antenna according to the present invention as a dipole antenna. In this case, one signal line of the balanced lines is connected to one of the radiating conductor 11 or one of the antenna body 10, and the other signal line of the balanced lines is connected to the other radiating conductor 11 or the other antenna body 10. Unbalanced lines may be modified into balanced lines through baluns, and the respective balanced lines may be connected to the respective radiating conductors 11 or the respective antenna bodies 10.

Although the antenna device according to the present invention has been described in detail, the present It is to be understood that modification and variation of the present invention may be made without departing from the sprit and scope of the present invention.

The present application claims priorities under 35 U.S.C. §119 to Japanese patent application number 2003-384324 filed Nov. 13, 2003 and Japanese patent application number 2004-156357 filed May 26, 2004. The contents of these applications are incorporated therein by reference in their entirety.

What is claimed is:

1. An antenna device comprising a dielectric member including a planar radiating conductor and a feeder;

the radiating conductor comprising a first forming element and a second forming element disposed so as to have a portion common to each other;

the first element being formed in a shape selected among a polygon, a substantial polygon, a circle, a substantial circle, an oval and a substantial oval;

the second element having at least one portion formed in a shape selected among a polygon, a substantial polygon, a circle, a substantial circle, an oval, a substantial oval, a trapezoid and a substantial trapezoid; and the feeder being connected to the radiating conductor.

2. The antenna device according to claim 1, wherein the feeder is connected to the radiating conductor at a peripheral portion of the second forming element in a peripheral portion of the radiating conductor, which is located on a side of the second forming element as seen from the first element.

3. The antenna device according to claim 2, wherein the dielectric member has a pair of ground patterns disposed at symmetrical positions with respect to the feeder.

4. The antenna device according to claim 1, wherein the feeder is connected to the radiating conductor at a peripheral portion of the second forming element in a peripheral portion of the radiating conductor, which is opposite the first forming element.

5. The antenna device according to claim 4, wherein the dielectric member has a pair of ground patterns disposed at symmetrical positions with respect to the feeder.

6. The antenna device according to claim 1, wherein the radiating conductor and the feeder are disposed on the dielectric member or in the dielectric member to form an antenna body;

the antenna body is mounted to an insulating substrate;

the insulating substrate has a ground conductor disposed on a surface thereof remote from the dielectric member or disposed therein; and the antenna body is mounted to the insulating substrate so that the dielectric member is disposed with the radiating conductor being parallel with or substantially parallel with the ground conductor.

7. The antenna device according to claim 6, wherein the insulating substrate includes a signal line forming a transmission line along with the ground conductor, and the signal line is connected to the feeder.

8. The antenna device according to claim 7, further comprising a reflecting member disposed away from the insulating substrate, the reflecting member being configured to reflect a radio wave radiated from the radiating conductor.

9. The antenna device according to claim 8, wherein the reflecting member comprises a flat plate and is disposed in parallel with or substantially parallel with the ground conductor of the insulating substrate.

10. The antenna device according to claim 8, further comprising an air layer disposed between the reflecting member and the insulating substrate.

11. The antenna device according to claim 8, further comprising a dielectric layer disposed between the reflecting member and the insulating substrate.

12. The antenna device according to claim 11, wherein the dielectric layer comprises a dielectric material having a relative dielectric constant in a range from 1.5 to 20.

13. The antenna device according to claim 6, further comprising a reflecting member disposed away from the insulating substrate, the reflecting member being configured to reflect a radio wave radiated from the radiating conductor.

14. The antenna device according to claim 13, wherein the reflecting member comprises a flat plate and is disposed in parallel with or substantially parallel with the ground conductor of the insulating substrate.

15. The antenna device according to claim 13, further comprising an air layer disposed between the reflecting member and the insulating substrate.

16. The antenna device according to claim 13, further comprising a dielectric layer disposed between the reflecting member and the insulating substrate.

17. The antenna device according to claim 16, wherein the dielectric layer comprises a dielectric material having a relative dielectric constant in a range from 1.5 to 20.

18. The antenna device according to claim 1, wherein the dielectric member has a pair of ground patterns disposed at symmetrical positions with respect to the feeder.

* * * * *